US006045277A

United States Patent [19]

Kurashina et al.

[11] Patent Number: 6,045,277

[45] **Date of Patent: *Apr. 4, 2000**

[54] TAPE PRINTING APPARATUS

[75] Inventors: Hiroyasu Kurashina; Takeshi Hosokawa, both of Nagano; Kenji Watanabe, Tokyo; Takanobu Kameda, Tokyo; Tomoyuki Shimmura, Tokyo; Chieko Aida, Tokyo, all of Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/827,874

[22] Filed: Apr. 11, 1997

[30] Foreign Application Priority Data

Apr. 15, 1996 [JP] Japan ..... 8-092894

[51] Int. Cl.[7] ..... B41J 11/26

[52] U.S. Cl. ..... 400/615.2; 400/61

[58] Field of Search ..... 400/61, 615.2

[56] References Cited

U.S. PATENT DOCUMENTS

| | | | |
|---|---|---|---|
| 3,937,493 | 2/1976 | Fasbender . | |
| 4,183,779 | 1/1980 | Barber et al. . | |
| 4,201,403 | 5/1980 | Turner . | |
| 4,204,639 | 5/1980 | Barber et al. . | |
| 4,240,848 | 12/1980 | Barber . | |
| 4,329,191 | 5/1982 | Barber . | |
| 4,544,182 | 10/1985 | Spring . | |
| 5,382,100 | 1/1995 | Sakuragi et al. | 400/9 |
| 5,441,586 | 8/1995 | Fukunaga et al. | 400/615.2 |
| 5,480,246 | 1/1996 | Morimoto | 400/615.2 |
| 5,562,353 | 10/1996 | Handa et al. | 400/615.2 |
| 5,575,573 | 11/1996 | Ito | 400/76 |

FOREIGN PATENT DOCUMENTS

| | | |
|---|---|---|
| 61-158478 | 7/1986 | Japan . |
| 61-175723 | 8/1986 | Japan . |
| 7156497 | 6/1995 | Japan . |
| 7195790 | 8/1995 | Japan . |
| 2564210 | of 1997 | Japan . |

*Primary Examiner*—John S. Hilten
*Attorney, Agent, or Firm*—Loeb & Loeb LLP

[57] ABSTRACT

A tape printing apparatus selects one of a plurality of kinds of print formats as a designated print format. Characters entered are arranged to form a character string. Print image data is formed by editing the character string based on the designated print format. Printing is carried out on a recording medium in the form of a tape being fed, based on the print image data. The plurality of kinds of print formats include any of a print format for printing by arranging each character of the character string in a direction other than a longitudinal direction of the printing medium in the form of a tape, a print format for printing by arranging the each character of the character string in a predetermined printable area, and a print format for printing by arranging the character string or the each character of the character string in a plurality of locations, and a print format for printing by changing an orientation of the each character in a direction different from an orientation thereof set in the character string.

28 Claims, 24 Drawing Sheets

FIG. 9A
○ INDEX／VERTICAL
| NAME OF OPTION | ENTRY GUIDE | PRINT SECTION | MAXMUM NUMBER OF CHARACTERS |
|---|---|---|---|
| _見出し／縦 | タイトル［ | (1) | 10 |
FIG. 9B1
タイトル［消耗備品費
FIG. 9C1
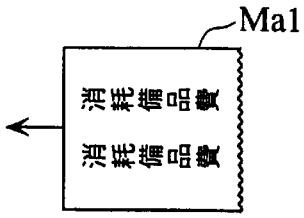
FIG. 9D1
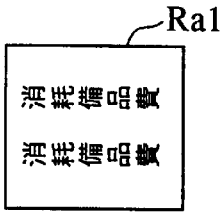
FIG. 9B2
タイトル［交通費
FIG. 9C2
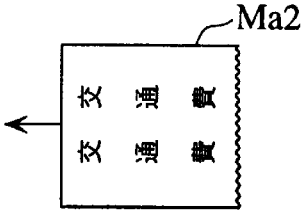
FIG. 9D2
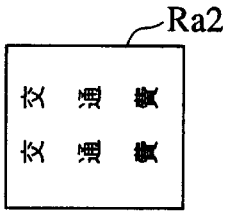
FIG. 9D3
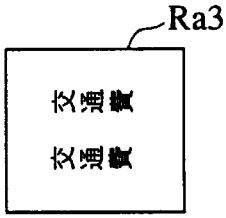
FIG. 9D4
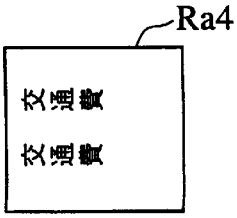
FIG. 9D5
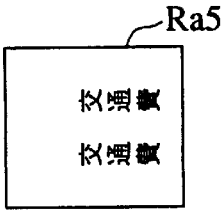

FIG. 10A
○ INDEX／HORIZONTAL
| NAME OF OPTION | ENTRY GUIDE | PRINT SECTION | MAXMUM NUMBER OF CHARACTERS |
|---|---|---|---|
| _見出し／横 | タイトル［ | (1) | 10 |
FIG. 10B1
タイトル［消耗備品費
FIG. 10C1
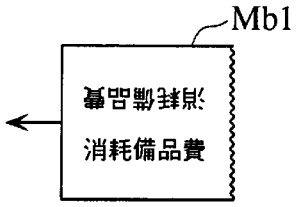
FIG. 10D1
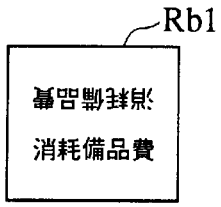
FIG. 10B2
タイトル［交通費
FIG. 10C2
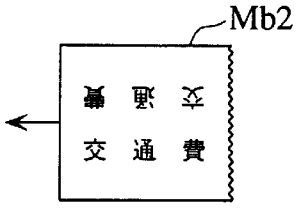
FIG. 10D2
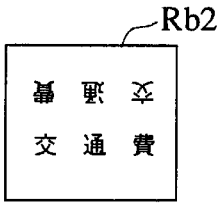
FIG. 10D3
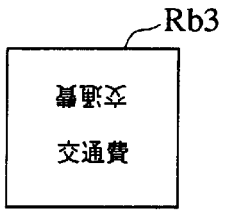
FIG. 10D4
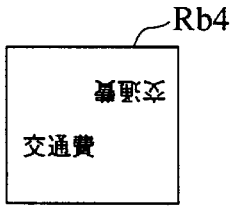
FIG. 10D5
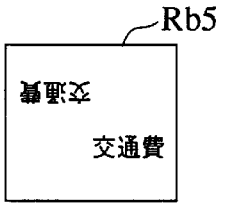
FIG. 10D6
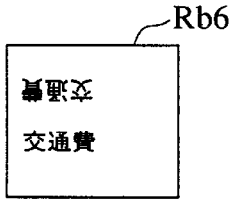
FIG. 10D7
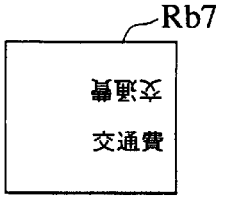

○ PORTRAIT／HOPRIZONTAL WRITING

| NAME OF OPTION | ENTRY GUIDE | PRINT SECTION | MAXMUM NUMBER OF CHARACTERS |
|---|---|---|---|
| _縦型よこ書 | 1行目［ | 1ST | 10 |
| | 2行目［ | 2ND | 10 |
| | ⋮ | ⋮ | ⋮ |
| | 32行目［ | 32TH | 10 |

1行目［たてとよこ。
2行目［印刷フォームの設定
3行目［A（n＋1）×d／b］
4行目［！$#%＝？：¥@&］
5行目［ABCDEFG
6行目［あいうえおかきくけこ］

FIG. 12A
○ LANDSCAPE／VERTICAL WRITING
| NAME OF OPTION | ENTRY GUIDE | PRINT SECTION | MAXMUM NUMBER OF CHARACTERS |
|---|---|---|---|
| __横型たて書 | 1行目［ | 1ST | 10 |
| | 2行目［ | 2ND | 10 |
| | ⋮ | ⋮ | ⋮ |
| | 32行目［ | 32TH | 10 |
FIG. 12B
1行目［たてとよこ。
2行目［印刷フォームの設定
3行目［A（n＋1）×d／b］
4行目［！$#%＝？：¥@&］
5行目［ABCDEFG
6行目［あいうえおかきくけこ］
FIG. 12C
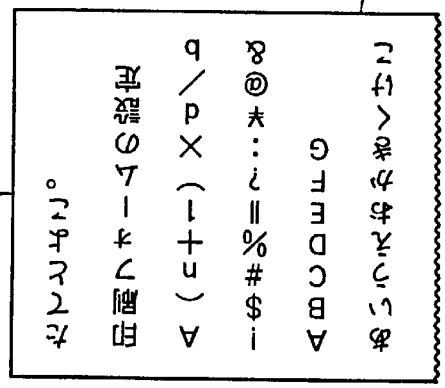
FIG. 12D
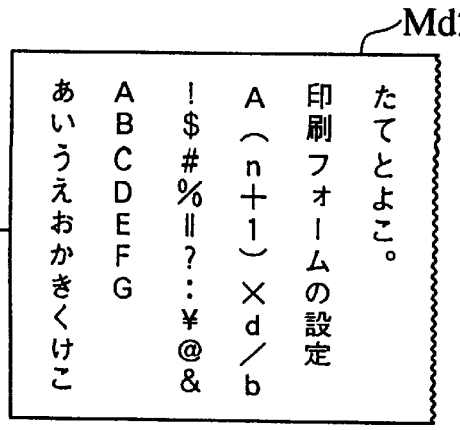

FIG. 15

| | CHARACTER ENTRY | PRE-EDITED FOR INDEX |
|---|---|---|
| (INDEX/ VERTICAL) | [交通費] | Ua1<br>交通費<br>交通費 |
| (INDEX/ HORIZONTAL) | [交通費] | Ub1<br>費通交<br>交通費 |
| (PORTRAIT/ HORIZONTAL WRITING) | [たてとよこ。]<br>[印刷フォームの設定]<br>[A(n+1)×d/b]<br>[!$#%=?:¥@&]<br>[ABCDEFG]<br>[あいうえおかきくけこ] | Uc1<br>たてとよこ。<br>印刷フォームの設定<br>A(n+1)×d/b<br>!$#%=?:¥@&<br>ABCDEFG<br>あいうえおかきくけこ |
| (LANDSCAPE/ VERTICAL WRITING) | [たてとよこ。]<br>[印刷フォームの設定]<br>[A(n+1)×d/b]<br>[!$#%=?:¥@&]<br>[ABCDEFG]<br>[あいうえおかきくけこ] | Ud1<br>たてとよこ。<br>印刷フォームの設定<br>A(n+1)×d/b<br>!$#%=?:¥@&<br>ABCDEFG<br>あいうえおかきくけこ |

FIG. 17

| | PRE-EDITED FOR INDEX | FONT DEVELOPED |
|---|---|---|
| (INDEX/ VERTICAL) | Ua1<br>交通費<br>交通費 | Ga1<br>交通費<br>交通費 |
| (INDEX/ HORIZONTAL) | Ub1<br>費通交<br>交通費 | Gb1<br>費通交<br>交通費 |
| (PORTRAIT/ HORIZONTAL WRITING) | Uc1<br>たてとよこ。<br>印刷フォームの設定<br>A（n＋1）×d／b<br>！＄＃％＝？：￥@&<br>ABCDEFG<br>あいうえおかきくけこ | Gc1<br>たてとよこ。<br>印刷フォームの設定<br>A（n＋1）×d／b<br>！＄＃％＝？：￥@&<br>ABCDEFG<br>あいうえおかきくけこ |
| (LANDSCAPE/ VERTICAL WRITING) | Ud1<br>たてとよこ。<br>印刷フォームの設定<br>A（n＋1）×d／b<br>！＄＃％＝？：￥@&<br>ABCDEFG<br>あいうえおかきくけこ | Gd1<br>たてとよこ。<br>印刷フォームの設定<br>A（n＋1）×d／b<br>！＄＃％＝？：￥@&<br>ABCDEFG<br>あいうえおかきくけこ |

FIG. 19

| | FONT DEVELOPED | CHARACTER IMAGE ORIENTED |
|---|---|---|
| (INDEX/ VERTICAL) | Ga1<br>交通費<br>交通費 | Ga2<br>交通費<br>交通費 |
| (INDEX/ HORIZONTAL) | Gb1<br>費通交<br>交通費 | Gb2<br>費通交<br>交通費 |
| (PORTRAIT/ HORIZONTAL WRITING) | Gc1<br>たてとよこ。<br>印刷フォームの設定<br>A（n＋1）×d／b<br>！＄＃％＝？：¥@&<br>ABCDEFG<br>あいうえおかきくけこ | Gc2<br>たてとよこ。<br>印刷フォームの設定<br>A（n＋1）×d／b<br>！＄＃％＝？：¥@&<br>ABCDEFG<br>あいうえおかきくけこ |
| (LANDSCAPE/ VERTICAL WRITING) | Gd1<br>たてとよこ。<br>印刷フォームの設定<br>A（n＋1）×d／b<br>！＄＃％＝？：¥@&<br>ABCDEFG<br>あいうえおかきくけこ | Gd2<br>たてとよこ。<br>印刷フォームの設定<br>A（n＋1）×d／b<br>！＄＃％＝？：¥@&<br>ABCDEFG<br>あいうえおかきくけこ |

FIG. 21

| | CHARACTER IMAGE ORIENTED | CHARACTER STRING IMAGE ARRANGED |
|---|---|---|
| (INDEX/ VERTICAL) | Ga2 交通費 交通費 | Ga3 交通費 交通費 |
| (INDEX/ HORIZONTAL) | Gb2 交通費 交通費 | Gb3 交通費 交通費 |
| (PORTRAIT/ HORIZONTAL WRITING) | Gc2 たてとよこ。 印刷フォームの設定 A（n＋1）×d／b ！＄＃％＝？：¥@& ABCDEFG あいうえおかきくけこ | Gc3 たてとよこ。 印刷フォームの設定 A（n＋1）×d／b ！＄＃％＝？：¥@& ABCDEFG あいうえおかきくけこ |
| (LANDSCAPE/ VERTICAL WRITING) | Gd2 たてとよこ。 印刷フォームの設定 A（n＋1）×d／b ！＄＃％＝？：¥@& ABCDEFG あいうえおかきくけこ | Gd3 たてとよこ。 印刷フォームの設定 A（n＋1）×d／b ！＄＃％＝？：¥@& ABCDEFG あいうえおかきくけこ |

FIG. 23

| | CHARACTER STRING IMAGE ARRANGED | POST-EDITED FOR INDEX |
|---|---|---|
| (INDEX/ VERTICAL) | Ga3 交通費 交通費 | Ga4 交通費 交通費 |
| | Gb3 交通費 交通費 | Gb4 交通費 交通費 |
| (PORTRAIT/ HORIZONTAL WRITING) | Gc3 たてとよこ。 印刷フォームの設定 A(n+1)×d/b !$#%=?:¥@& ABCDEFG あいうえおかきくけこ | Gc4 たてとよこ。 印刷フォームの設定 A(n+1)×d/b !$#%=?:¥@& ABCDEFG あいうえおかきくけこ |
| (LANDSCAPE/ VERTICAL WRITING) | Gd3 たてとよこ。 印刷フォームの設定 A(n+1)×d/b !$#%=?:¥@& ABCDEFG あいうえおかきくけこ | Gd4 たてとよこ。 印刷フォームの設定 A(n+1)×d/b !$#%=?:¥@& ABCDEFG あいうえおかきくけこ |

TAPE PRINTING APPARATUS

BACKGROUND OF THE INVENTION

1. Field of the Invention

This invention relates to a tape printing apparatus for printing entered characters, such as letters and symbols, on a recording medium in the form of a tape, so as to obtain printed labels or the like.

2. Prior Art

Recently, small-sized tape printing apparatuses have appeared on the market, which are called label printers or label word processors and print on a recording medium in the form of a tape. Tape printing apparatuses of this kind are capable of cutting a printed portion of the recording medium to a desired length. The recording medium, in general, has an adhesive surface on the reverse side thereof, via which the printed portion cut off from the tape can be affixed to a desired location.

The tape printing apparatuses print, differently from word processors and type writers, on a tape continuous and narrow in width by means of a print head arranged at a fixed location therein by feeding the tape in one direction. Entered characters are sequentially arranged along the length of the tape to form character strings, and the character strings, in vertical writing or horizontal writing, are printed. Throughout the specification and claims appended hereto, "vertical writing" means that characters and/or symbols are arranged in a line or lines such that they should be read vertically, i.e. as a vertical character string or vertical character strings, as found in conventional Japanese or Chinese writings, while "horizontal writing" means that characters and/or symbols are arranged in a line or lines such that they should be read as a horizontal character string or horizontal character strings, as in normal English writings.

When papers or document files are systematically organized and arranged, for example, one commonly-used method is to provide indexes in the form of tabs (hereinafter referred to as "index tabs") on the papers or document files in a fashion protruded therefrom so as to facilitate search of them for a paper or file in need. Each index can be provided by preparing a pair of labels having the same length and printed with the same contents, and attaching the labels to a paper itself to form a tab or to the surfaces of a tab formed on a file, such that the labels are attached back to back, to thereby permit the printed portions to be read from either side of the paper or file.

When the conventional tape printing apparatuses are used to form such labels for making index tabs, however, it is required to form a pair of labels having the same length and printed with the same contents and paste or stick them back to back. This requires labor of printing a pair of separate labels and pasting or sticking them to each other.

On the other hand, the main use of the tape printing apparatus is to form a general-purpose label, so that it is not necessarily required to print characters in a transverse direction of the tape. Therefore, the conventional tape printing apparatus are not capable of, for example, forming a label having a top portion printed with a postal code in horizontal writing which extends in the horizontal direction of the tape, and a lower portion printed with an address and a name in vertical writing which extend in the longitudinal direction of the tape. Further, it is also impossible for the conventional apparatuses to print a composition of a number of lines in vertical writing each formed by a relatively small number of letters, such as lyric lines, haiku (Japanese poem in shortest-form), and waka (Japanese poem in short-form), on a single label. To form a label printed with such contents, it is required to prepare a plurality of labels separately, and then paste or stick them to a desired place while accurately positioning them into a desired form.

SUMMARY OF THE INVENTION

It is an object of the invention to provide a tape printing apparatus which is capable of carrying out printing for special purposes, e.g. to form a label for an index tab or a label having characters printed in mixed directions, i.e. in a mixture of character strings in vertical writing and horizontal writing.

To attain the above object, the invention provides a tape printing apparatus, comprising:

- print format-designating means for selecting one kind of print format as a designated print format, from a plurality of kinds of print formats;
- entry means for arranging entered characters to form a character string;
- print image-forming means for forming print image data by editing the character string based on the designated print format; and
- printing means for printing on a recording medium in the form of a tape being fed, based on the print image data.

The tape printing apparatus is characterized in that the plurality of kinds of print formats include any of a print format for printing by arranging each character of the character string in a direction other than a longitudinal direction of the printing medium in the form of a tape, a print format for printing by arranging the each character of the character string in a predetermined printable area, and a print format for printing by arranging the character string or the each character of the character string in a plurality of locations, and a print format for printing by changing an orientation of the each character in a direction different from an orientation thereof originally set in the character string.

The tape printing apparatus according to the invention has a plurality of print formats, and forms print image data by editing character strings based on a designated one of the print formats, and carries out printing based on the print image data. That is, the tape printing apparatus has various print formats ready for use, which meet needs of users, such as a print format for printing by arranging each character of the character string in a direction other than a longitudinal direction of the printing medium in the form of a tape, a print format for printing by arranging the each character of the character string in a predetermined printable area, and a print format for printing by arranging the character string or the each character of the character string into a plurality of locations, and a print format for printing by changing an orientation of the each character in a direction different from an orientation thereof originally set in the character string, whereby the apparatus is capable of effecting printing in various formats on an identical tape-shaped recording medium. Therefore, by cutting off printed portions of the recording medium, labels suitable for various uses can be obtained.

Preferably, the plurality of print formats are grouped into a first print format group including a vertical writing print format for printing by making a lateral direction of the each character in agreement with a transverse direction of the recording medium in the form of a tape and arranging the each character in the longitudinal direction of the recording medium in the form of a tape, and a horizontal writing print format for printing by making a vertical direction of the each character of the character string in agreement with the transverse direction of the recording medium in the form of a tape and arranging the each character in the longitudinal direction of the recording medium in the form of a tape, and a second print format group including other print formats than the vertical writing print format and the horizontal writing print format.

According to this preferred embodiment, it is possible to use, in addition to a first print format group having a vertical writing print format and a horizontal writing print format in which character strings are each arranged in the longitudinal direction of the tape, i.e. print formats similar to conventional print formats for printing character strings, a second print format group which comprises print formats other than the first print format group, that is, special print formats, such as a combination of a print format for vertical writing and a print format for horizontal writing which have character strings arranged along respective different directions, as two completely separate and distinguished groups of formats, whereby the present apparatus preserves upward compatibility with conventional tape printing apparatuses. As a result, the present apparatus can be easily accepted by users familiar with the conventional apparatuses.

Preferably, the plurality of print formats include a vertical writing index tab print format and a horizontal writing index tab print format, the vertical writing index tab print format and the horizontal writing index tab print format each being used for making a label for an index tab, and when any of the vertical writing index tab print format and the horizontal writing index tab print format is designated, the print image-forming means automatically sets length of a printable area on the recording medium to a predetermined value suitable for the index tab, and forms the print image data by arranging character image data corresponding to the each character of the character string in an area corresponding to the printable area having the length thereof set to the predetermined value.

According to this preferred embodiment, when any of the print formats for making labels for index tabs is designated, the length of a printable area is automatically set according to the index tab, and image data of each character string is arranged according to the length of the printable area. Therefore, it is possible to carry out printing in a manner conforming to the length of the index tab based on the resulting arrangement of the print image data. This makes it possible to save the trouble of setting the length of a printable area and properly arranging the characters therein. Further, the printed portion cut off from the tape provides a label for an index tab having an excellent appearance.

Preferably, the plurality of print formats include a vertical writing index tab print format, and when the vertical writing index tab print format is selected as the designated print format, the print image-forming means forms vertical writing character string image data by making a lateral direction of character image data corresponding to the each character of the character string in agreement with a direction corresponding to a transverse direction of the recording medium in the form of a tape, and arranging the character image data in a direction corresponding to the longitudinal direction of the recording medium in the form of a tape, and forms the print image data by arranging the vertical writing character string image data at both of a location corresponding to one side of a center line in the longitudinal direction of the recording medium in the form of a tape and a location corresponding to another side of the center line.

According to this preferred embodiment, print image data is formed by arranging character image data items of character string image data having the same contents in vertical writing at locations respectively corresponding to both sides of a center line in the longitudinal direction of the recording medium in the form of a tape. Therefore, when printing is carried out based on the print image data, the character strings having the same contents in vertical writing are formed on the both sides of the center line in the longitudinal direction of the recording medium in the form of a tape. The label thus formed can be bent along the center line, so that it is possible to easily form index tabs printed with character strings formed of the same letters and/or symbols on both sides thereof. As a result, it is possible to save the labor of attaching a pair of separate labels printed with the characters to each other.

Preferably, the plurality of print formats include a horizontal writing index tab print format, and when the horizontal writing index tab print format is designated as the designated print format, the print image-forming means forms first horizontal writing character string image data by making a vertical direction of character image data corresponding to the each character of the character string in agreement with a direction corresponding to a transverse direction of the recording medium in the form of a tape and arranging the character image data in the direction corresponding to the longitudinal direction of the recording medium in the form of a tape, and second horizontal writing character string image data by arranging the character image data in a direction corresponding to a direction opposite to the longitudinal direction of the recording medium in the form of a tape such that the second character string image data is in an inverted position and in point symmetry with the first horizontal writing character string image data, and forms the print image data by arranging the first horizontal writing character string image data at a location corresponding to one side of a center line in the longitudinal direction of the recording medium in the form of a tape and the second horizontal writing character string image data at a location corresponding to another side of the center line in the longitudinal direction of the recording medium in the form of a tape.

According to this preferred embodiment, print image data is formed in which character string image data items having the same contents are arranged at locations respectively corresponding to both sides of a center line in the longitudinal direction of the recording medium in the form of a tape in a point symmetrical manner. That is, there are arranged at one of locations respectively corresponding to both sides of the center line in the longitudinal direction of the recording medium, e.g. on a lower side, the first horizontal writing character string image data formed by arranging the each character image data item in the direction corresponding to the longitudinal direction of the recording medium in the form of a tape, whereas at the other of the locations, e.g. on an upper side, second horizontal writing character string image data formed by rotating the each character image data item to an inverted point-symmetrical position thereby arranging the each character image data item in a direction corresponding to a direction opposite to the longitudinal direction of the recording medium in the form of a tape, so that the second horizontal writing character string image data forms a point symmetrical rotation of the first horizontal writing character string image data. When printing is carried out based on the print image data thus obtained, the horizontal writing character strings having the same contents are printed on both sides of the center line in the longitudinal direction of the recording medium in the form of a tape in a point-symmetrical manner. The label thus formed can be bent along the center line, so that it is possible to easily form index tabs printed with character strings formed of the same letters and/or symbols on both sides thereof. As a result, it is possible to save the labor and time of attaching a pair of separate labels printed with the characters to each other. Further, it is possible to make a setting such that a label is formed which is reversed in the relationship of the upper side and the lower side, i.e. which has the character string on the lower side in an inverted position in the case of the above example, or this setting may be provided as another print format for selection.

Preferably, the plurality of print formats include a portrait horizontal writing print format, and when the portrait horizontal writing print format is selected as the designated print format, the print image-forming means forms the print image data by making a lateral direction of character image data corresponding to the each character of the character string in agreement with a direction corresponding to a transverse direction of the recording medium in the form of a tape, and arranging the character image data in the transverse direction of the recording medium in the form of a tape.

According to this preferred embodiment, print image data is formed by arranging image data of each character in horizontal writing in the transverse direction of the recording medium in the form of a tape, and printing is carried out based on the thus prepared print image data, whereby character strings in horizontal writing can be printed in the transverse direction of the recording medium in the form of a tape. This makes it possible to print a postal code in horizontal writing in the transverse direction and then an address and a name in vertical writing in the longitudinal direction to thereby form a label in which character strings in vertical writing and horizontal writing are arranged longitudinally and transversely in a mixed manner, which conventional tape printing apparatuses cannot effect. As a result, it is possible to save effort and time for forming a plurality of labels separately and affixing them by accurately positioning them with respect to each other.

Preferably, the plurality of kinds of print format include a landscape vertical writing print format, and when the landscape vertical writing print format is selected as the designated print format, the print image-forming means forms the print image data by making a vertical direction of character image data corresponding to the each character of the character string in agreement with a direction corresponding to a transverse direction of the recording medium in the form of a tape, and arranging the character image data in the transverse direction of the recording medium in the form of a tape.

According to this preferred embodiment, print image data is formed by arranging image data of each character in vertical writing in a direction corresponding to the direction of the transverse direction of the recording medium in the form of a tape, and printing is carried out based on the thus prepared print image data, whereby character strings in vertical writing can be printed in the transverse direction of the recording medium in the form of a tape. This makes it possible to print a composition of a number of lines each formed by a relatively small number of letters, such as lyric lines, haiku, and waka, in a single label, which conventional tape printing apparatuses cannot effect. Therefore, the present apparatus saves the effort and time for forming a plurality of labels separately and pasting or sticking them by accurate positioning to provide neat and uniform space between each adjacent pair of lines.

The above and other objects, features, and advantages of the invention will become more apparent from the following detailed description taken in conjunction with the accompanying drawings.

BRIEF DESCRIPTION OF THE DRAWINGS

FIGS. 9A to 9D5 are diagrams which are useful in explaining a IND/V (Index/Vertical) print format as one of special print formats;

FIGS. 10A to 10D7 are diagrams which are useful in explaining a IND/H (Index/Horizontal) print format as one of the special print formats;

FIGS. 12A to 12D are diagrams which are useful in explaining a LS/VW (Landscape/Vertical writing) print format as one of the special print formats;

FIG. 15 shows a table showing examples of data input and data output in the FIG. 14 subroutine;

FIG. 17 shows a table showing examples of data input and data output in the FIG. 16 subroutine;

FIG. 19 shows a table showing examples of data input and data output in the FIG. 18 subroutine;

FIG. 21 shows a table showing examples of data input and data output in the FIG. 20 subroutine;

FIG. 23 shows a table showing examples of data input and data output in the FIG. 22 subroutine.

DETAILED DESCRIPTION

The invention will now be described in detail with reference to the drawings showing a preferred embodiment thereof.

Figure 1:
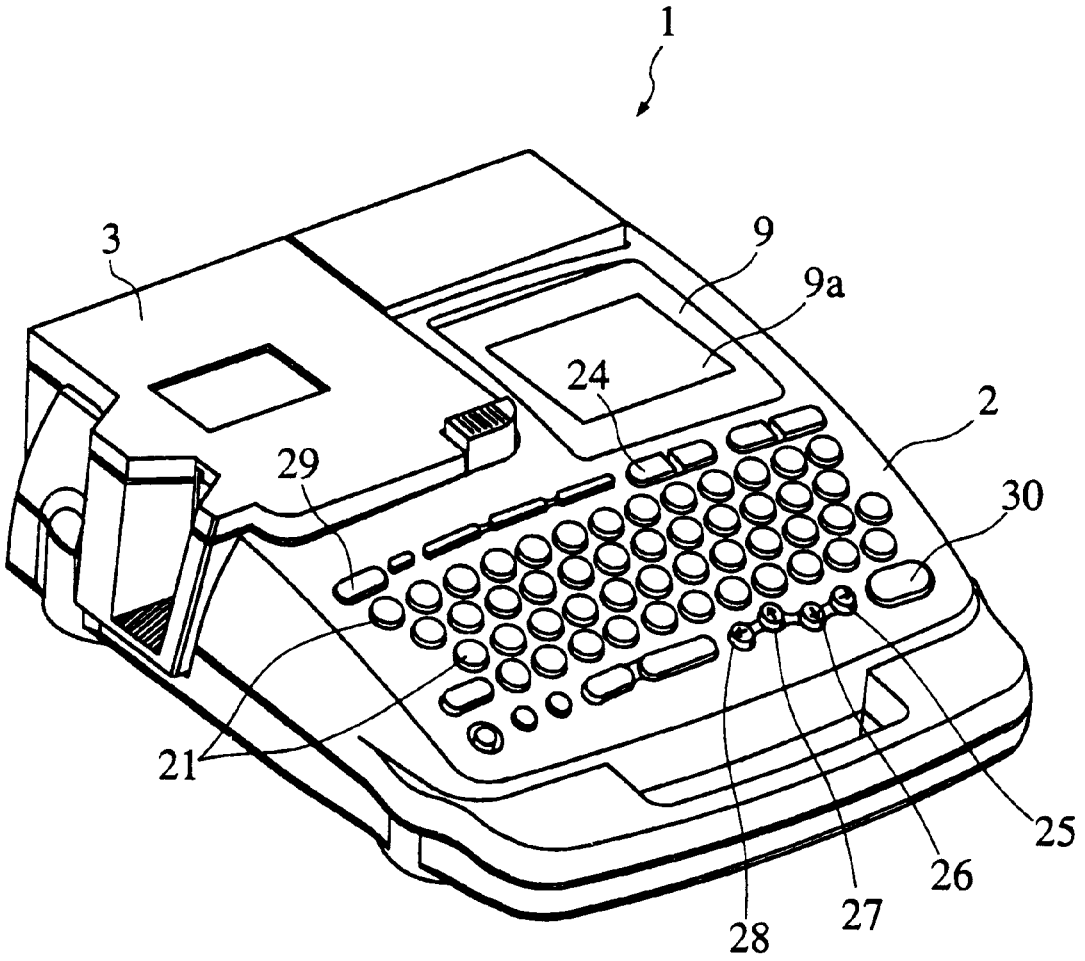
FIG. 1 is a perspective view showing an appearance of a tape printing apparatus according to an embodiment of the invention.
Figure 2:
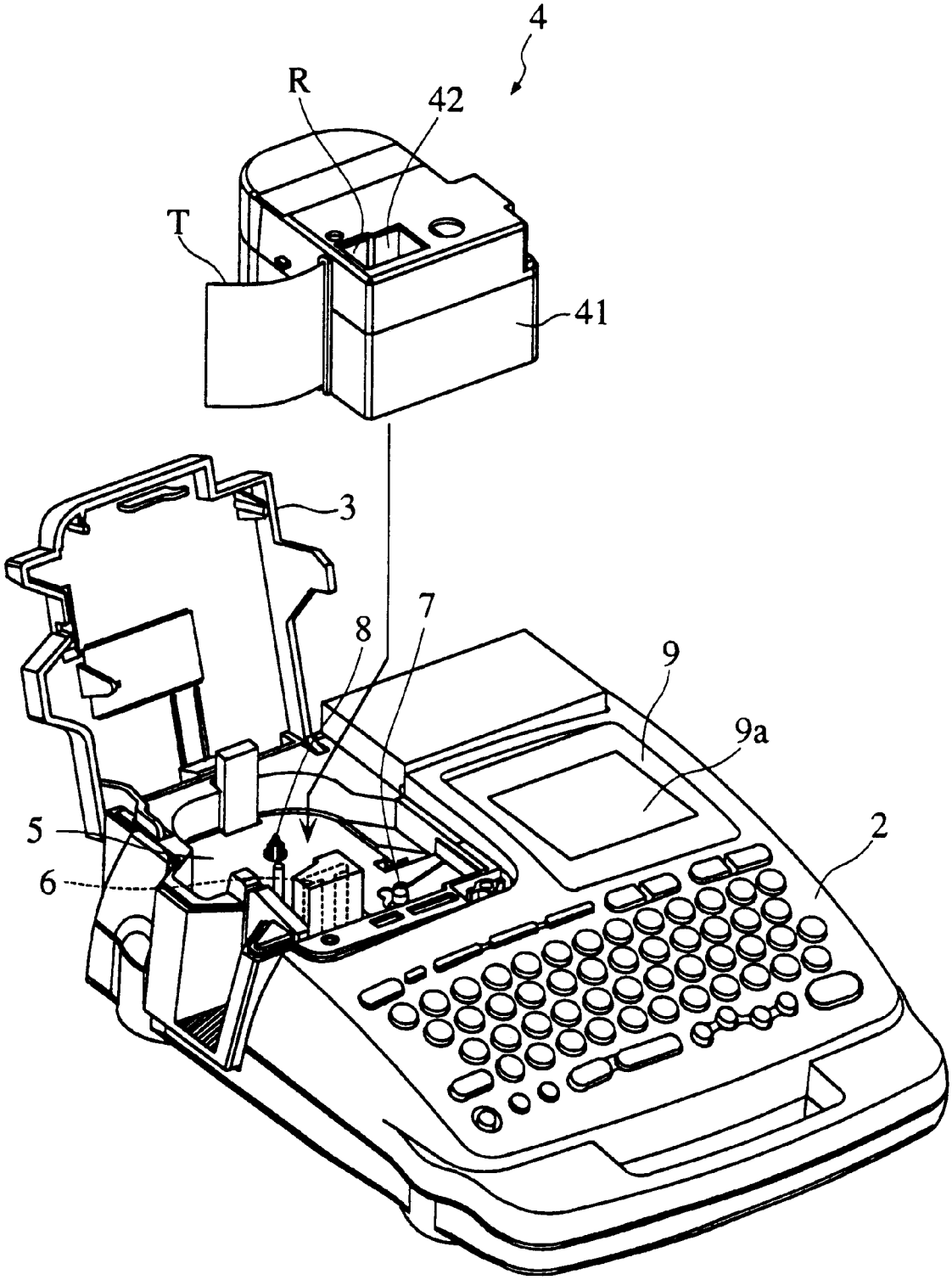
FIG. 2 is a perspective view showing the FIG. 1 tape printing apparatus with its lid open, and a tape cartridge removed therefrom.

Referring first to FIGS. 1 and 2, there are shown appearances of a tape printing apparatus 1 according to an embodiment of the invention. The tape printing apparatus 1 includes a keyboard 2 arranged on a front portion of the top thereof, a liquid crystal display 9 arranged in a right-hand rear portion of the same, and a lid 3 arranged on a left-hand rear portion of the same. The liquid crystal display 9 has a display screen 9*a* which is capable of displaying line numbers and four lines each including six characters, at a time, in a normal text display mode.

Arranged on the keyboard 2 are a character key group 21 including alphabet keys and number keys, and a function key group for designating various operation modes and the like. The function key group includes a file/format key 24 for handling files and selecting a print format, four cursor-moving keys 25, 26, 27 and 28 for moving a cursor in respective rightward (→), downward (↓), upward (↑), and leftward (←) directions, a print key 29, and a selection key 30.

As shown in FIG. 2, under the lid 3, a loading block 5 is formed for mounting or loading a tape cartridge 4 therein. The tape cartridge 4 contains a recording medium (tape) T having a fixed width. The tape T has its reverse side thereof formed with an adhesive surface and covered with a peel-off paper. The tape cartridge 4 contains an ink ribbon R together with the tape T. The tape T and the ink ribbon R are fed or run such that they pass a window 42 formed in the tape cartridge 4 in a state lying one upon another, and the tape T alone is delivered out of the tape cartridge 4 and then from the apparatus, but the ink ribbon R is taken up into a roll within the tape cartridge 4.

The loading block 5 has a thermal head (printing means) 6 arranged therein, which faces the reverse side of the ink ribbon R exposed to the outside of the tape cartridge 4 from the window 42 thereof when the tape cartridge 4 is loaded in the loading block 5. Then, by driving the thermal head 6 while heating the same, desired letters and the like are printed on the surface of the tape T. Further, the loading block 5 has drive shafts 7 and 8 arranged therein for engagement with driven portions of the tape cartridge 4 loaded or mounted in the loading block 5. These drive shafts 7 and 8 cause the tape T and the ink ribbon R to be fed or carried in the tape cartridge 4.

Figure 3:
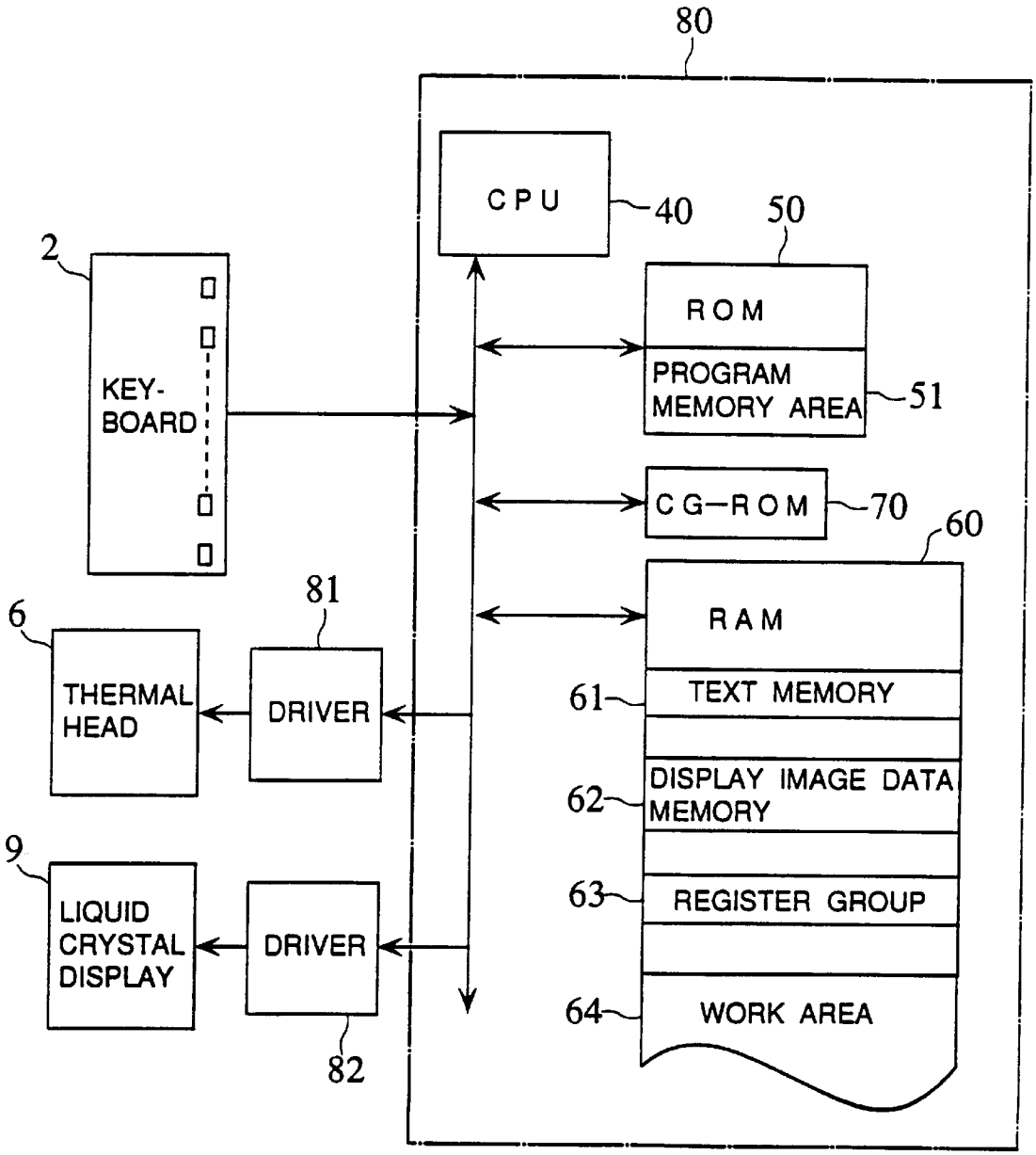
FIG. 3 is a block diagram schematically showing the arrangement of a control system of the FIG. 1 tape printing apparatus.

Next, a control system of the tape printing apparatus 1 will be described with reference to FIG. 3. The control system includes a control circuit 80 comprised of a CPU 40, a ROM (Read Only Memory) 50, a RAM (Random Access Memory) 60, and a character generator ROM (hereinafter referred to as "CG-ROM") 70. The control circuit 80 has its input port connected to the keyboard 2, and its output port connected to the thermal head 6 via a driver 81 for driving the same, and to the liquid crystal display 9 via a driver 82 for driving the same for display operation.

The ROM 50 has a program memory area 51 storing control programs for controlling the thermal head 6 and the liquid crystal display 9, and various programs for executing processing operations, described hereinafter. The RAM 60 includes a text memory 61 for temporarily storing text data of letters and symbols entered via the keyboard 2, a display image data memory 62 for storing image data corresponding to contents displayed on the display screen 9*a* of the liquid crystal display 9, a register group 63 for temporarily storing results of processing by the CPU 40, a work area 64 for forming image data and the like therein during various kinds of processing described hereinafter. The CG-ROM 70 stores font data of letters and symbols provided for the tape printing apparatus 1, and outputs corresponding font data when code data specifying a letter or the like is given thereto.

Next, overall processing carried out by the tape printing apparatus 1 will be described with reference to FIG. 4 et seq. Processing responsive to basic operations, such as movement of the cursor by the cursor key 25 etc., and other processing responsive to operations of function keys, which are not directly related to the present invention, will be collectively shown as "PROCESSING RESPONSIVE TO OPERATION OF OTHER FUNCTION KEYS (S11)" and detailed description thereof will be omitted.

Figure 4:
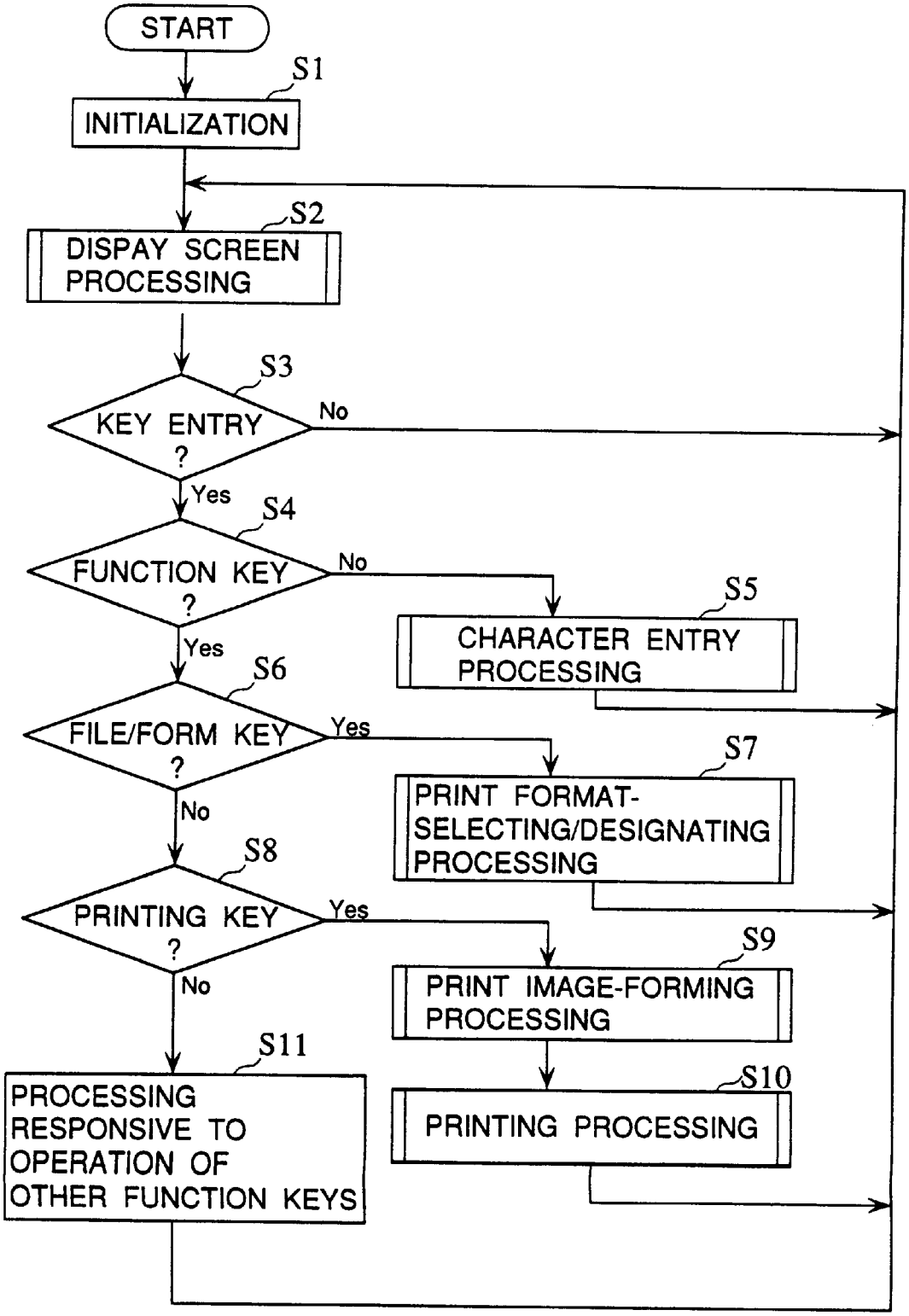
FIG. 4 is a flowchart showing a program for the overall control processing carried out by the FIG. 1 tape printing apparatus.

Referring to FIG. 4, when the processing is started e.g. by turning on the power to the tape printing apparatus 1, first, at a step S1, initialization including the restoring of saved control flags is carried out to restore the tape printing apparatus 1 to a state before the power is turned off. Then, display screen processing is carried out at a step S2. For explanation purposes, the following description will be made assuming that a normal print format (first print format group) is designated for carrying out the same printing as carried out by a conventional tape printing apparatus, and the system is initialized to a wait sate for key entry.

Figure 5A:
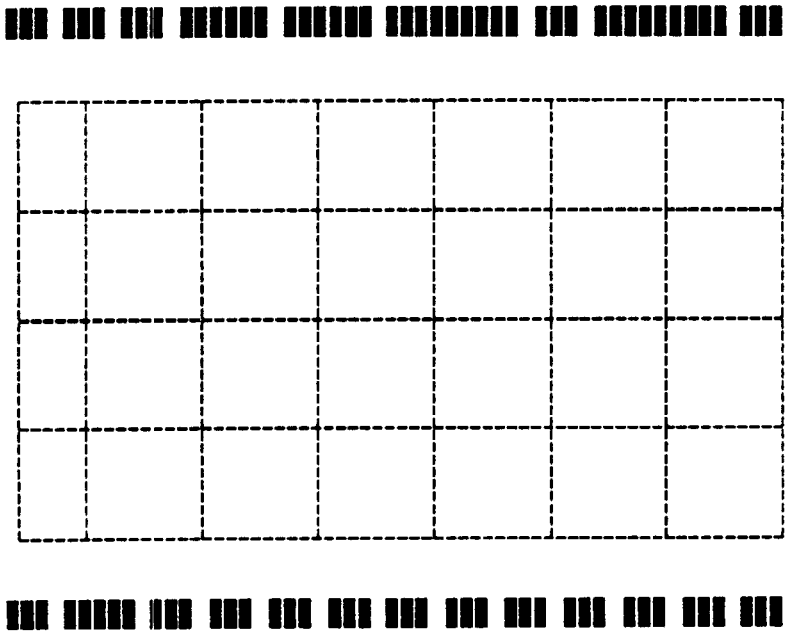
FIGS. 5A is a diagram showing construction of a display screen.
Figure 5B:
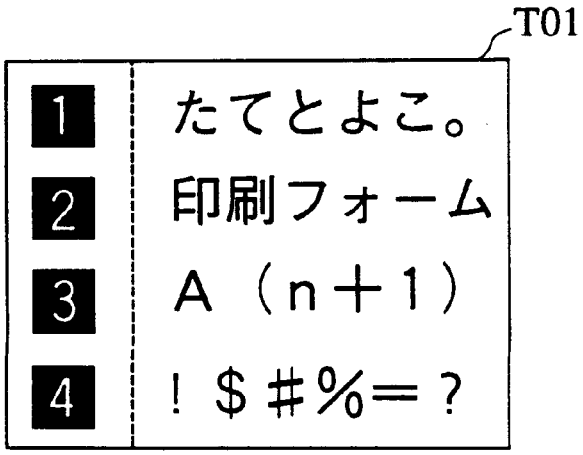
FIG. 5B is a diagram showing an example of a display on the display screen.

As shown in FIG. 5A, the display screen 9*a* is capable of displaying text data of four line numbers on the leftmost column and six characters corresponding to each of the line numbers when the normal print format is designated, and FIG. 5B shows an example of an actual display on the display screen 9*a*. (Hereafter, each display on the display screen 9A is referred to as a "screen T??" (? represents a digit or a letter) and shown with the reference numeral T??.)

Figure 6A:
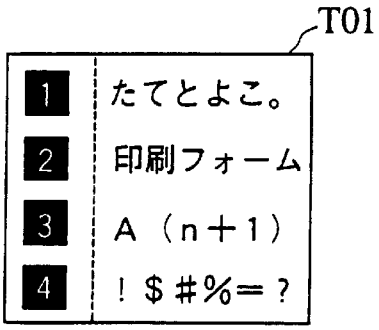
FIGS. 6A to 6C are diagrams showing examples of displays on the display screen, respectively.
Figure 6B:
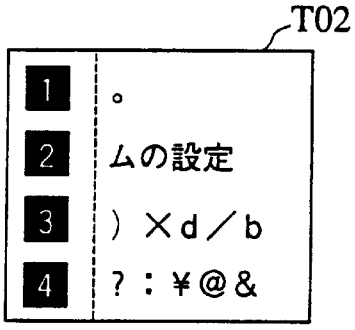
Figure 6C:
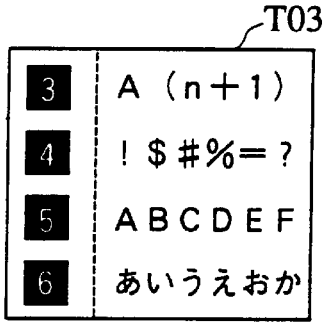
Figure 6D:
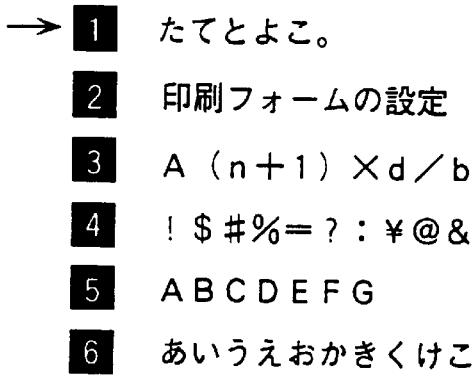
FIG. 6D is a diagram showing text data entered.

FIG. 6A shows the same screen T01 as shown in FIG. 5B, and the contents of text actually entered are shown in FIG. 6D. Now, the procedure of entering text data when the normal print format is designated will be described on this example of text data with reference to FIGS. 4 and 7A to 7L.

Figure 7A:
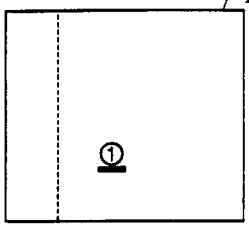
FIGS. 7A to 7L are diagrams showing examples of displays appearing on the display screen as text data is entered when a normal print format is selected.
Figure 7B:
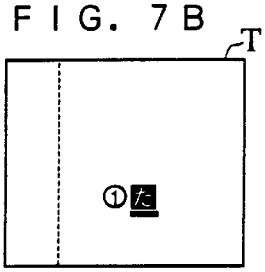

When the tape printing apparatus 1 is initialized to a screen T11 shown in FIG. 7A, if a Japanese hirakana character "た" (pronounced as "ta") is entered via the keyboard, it is determined at a step S3 in FIG. 4 that a key entry has been made. Then, after it is determined at a step S4 that the operated key is not a function key, character entry processing is carried out at a step S5. In the character entry processing (S5), the text data of "た(ta)" is stored in the text memory 61, and font data corresponding thereto is read from the CG-ROM 70, to store image data of "た(ta)" in reverse video at a location in the display image data memory 62 which corresponds to a position of image display data of the cursor stored therein, whereby when the display screen processing (S2) is executed again, a screen T12 as shown in FIG. 7B is displayed. The character "た(ta)" is displayed in reverse video to indicate that the entry thereof is not yet settled or fixed.

Figure 7C:
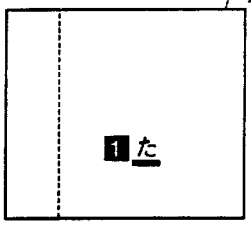

Then, if the selection key 30 is depressed to settle or fix the entry of the character "た(ta)", it is determined at the step S3 that a key entry has been made (Yes to S3), at the step S4 that a function key has been operated (Yes to S4), and at a step S6 that the operated function key is not the file/format key 24 (No to S6). After it is further determined at a step S8 that the operated key is not the print key 29 (No to S8), the settling of text entry of the character "た(ta)" is effected at a step S11. That is, the image data of "た(ta)" in the display image data memory 62 in reverse video is replaced by an image data of the same in normal video. As a result, when the display screen processing (S2) is carried out again, a screen T13 shown in FIG. 7C is displayed.

Figure 7D:
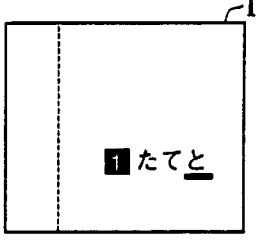
Figure 7E:
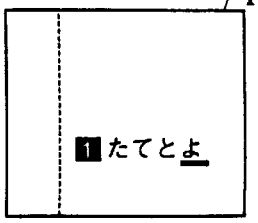
Figure 7F:
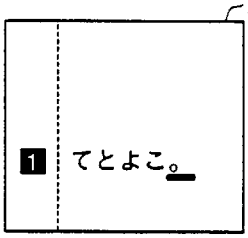
Figure 7G:
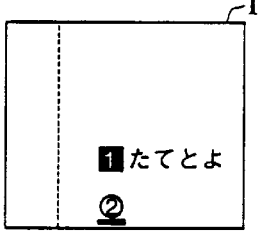
Figure 7H:
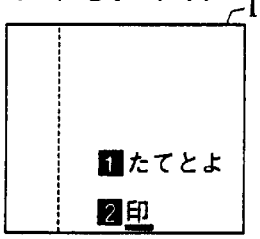
Figure 7I:
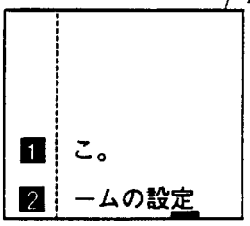
Figure 7J:
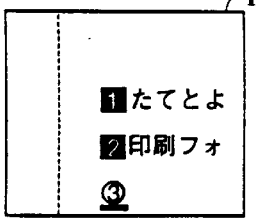
Figure 7K:
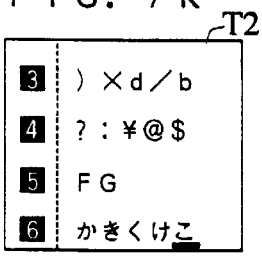
Figure 7L:
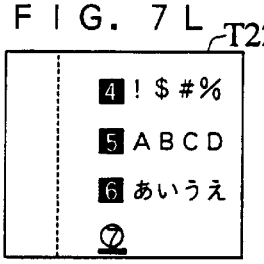

If the remaining text data of Japanese hirakana characters "てとよこ" ("te, to, yo, ko") is similarly entered as in screens T14 to T16 shown in FIGS. 7D to 7F, and the selection key 30 is depressed, a screen T17 shown in FIG. 7G appears in which text entry is guided on a second line. This is because the selection key 30 also plays the roll of a line feed key. When text data of Japanese characters "印刷フォームの設定" (which means "the setting of a print format") is entered for the second line (screens T18 and T19 shown in FIGS. 7H and 7I) and the line is fed by operating the selection key 30, in the same manner, a screen T20 shown in FIG. 7J appears in which entry of text data is guided on a third line. When text data is similarly entered down to a sixth line (screen T21 shown in FIG. 7K), and then the selection key 30 is depressed, a screen T22 shown in FIG. 7L appears in which text entry is guided on a seventh line, which completes the entry of text data intended at present.

In the text data entry processing, code data of "Null"=(0000)HEX (hereinafter referred to as "Null data") is always placed at a position following the position of the cursor which guides entry of text data, whereby text data is always entered immediately before the Null data. In other words, the Null data indicates the end of text data.

After the entry of text data, it is possible to make sure of the entered text by operating the four cursor-moving keys 25, 26, 27 and 28 for moving the cursor in respective rightward (→), downward (↓), upward (↑), and leftward (←) directions (hereinafter these keys will be referred to as "the cursor (→) key 25", "the cursor (↓) key 26", "the cursor (↑) key 27" and "the cursor (←) key 28". For example, by continually depressing the cursor (→) key 25 from the state shown in FIG. 6A, the displayed area is shifted toward the end of the line on which the cursor is positioned, whereby the entered text data (see T02 shown in FIG. 6B) can be checked, whereas by continually depressing the cursor (↓) key 26, the displayed area is shifted to lower lines (screen T03 of FIG. 6C), similarly by the cursor (↑) key 27, to upper lines, and by the cursor (←) key 28, toward the head of the line on which the cursor is positioned.

If the print key 29 is depressed in such a state of display on the screen described above, it is determined at the step S3 in FIG. 4 that a key entry has been made (Yes to S3), at the step S4 that the operated key is the function key (Yes to S4), and at the step S6 that the operated key is not the file/format key 24 (No to S6) Then, after it is determined at the step S8 that the operated key is the print key 29 (Yes to S8), print image data is formed by the print image-forming processing, referred to hereinafter, at a step S9, and the printing is carried out at a step S10 based on the print image data. Then, the screen returns to the wait state for key entry at the step S2.

Figure 6E:
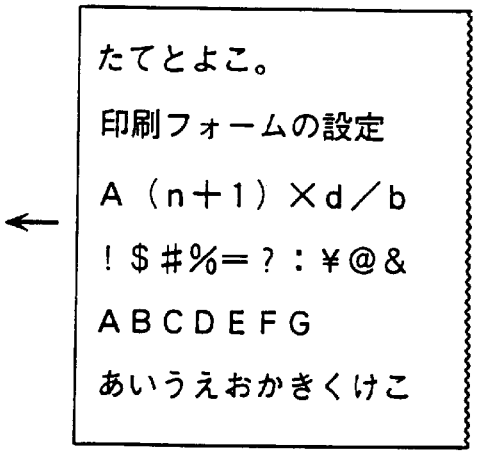
FIGS. 6E and 6F are diagrams showing print images printed according to respective normal print formats.
Figure 6F:
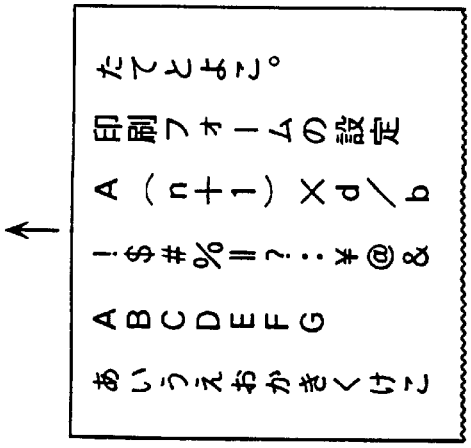
Figure 20:
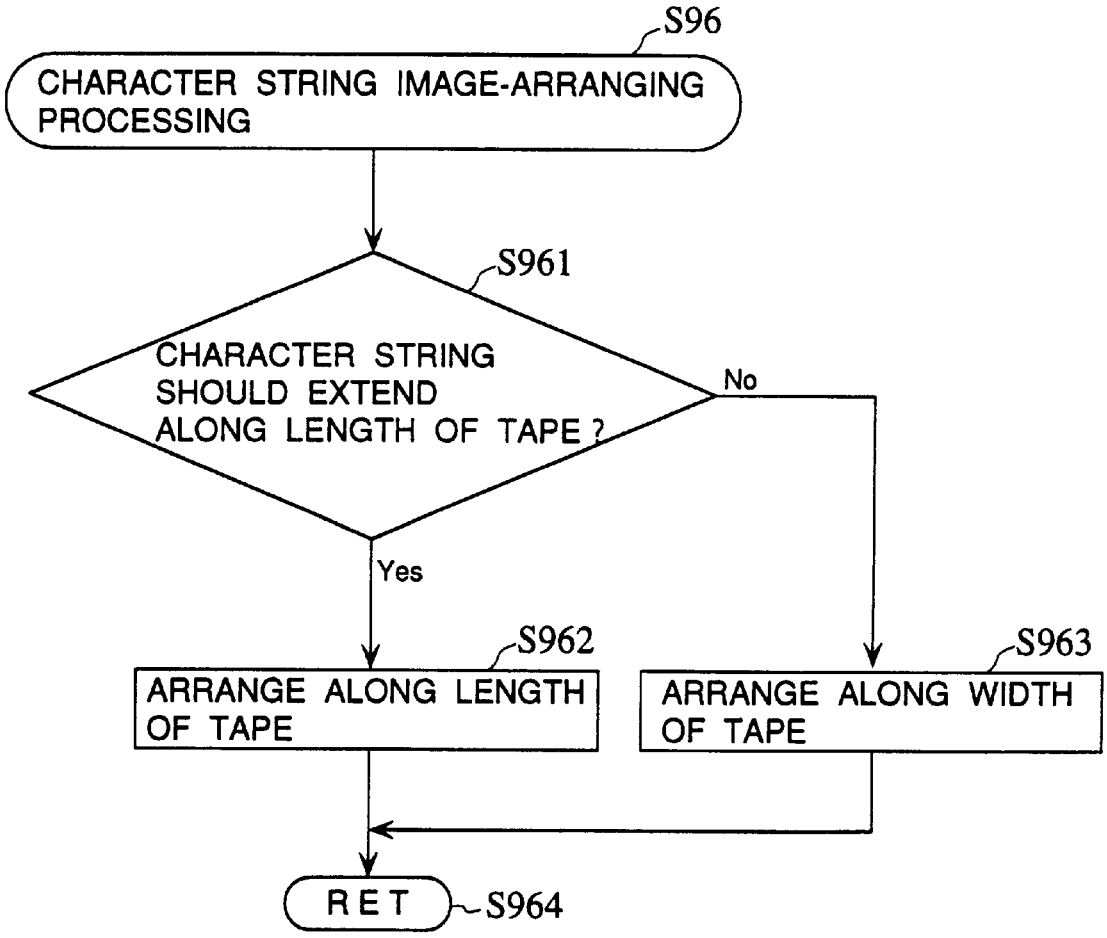
FIG. 20 is a flowchart showing a subroutine for character string image-arranging processing executed in the FIG. 13 routine.

In the print image-forming processing (S9) carried out when the normal print format is selected, character string image-arranging processing (S96), described in detail hereinafter with reference to FIG. 20, is carried out to arrange the character images along the length of the tape at a step S962 whereby the characters are printed in lines parallel to each other in a direction (indicated by an arrow) of the feeding of the tape T, as shown in FIG. 6E when a horizontal writing print format is designated, or as shown in FIG. 6F when a vertical writing print format is designated.

Next, special print formats (second print format group) will be described.

Referring to FIG. 4, in the course of the display screen processing (S2) for the normal print format, if the file/format key 24 is depressed, it is determined that a key entry has been made (Yes to S3), that the operated key is a function key (Yes to S4), that the operated function key is the file/format key 24 (Yes to S6), and then print format-selecting/designating processing is carried out at a step S7. Once a special print format is selected and designated, as described hereinafter, the character entry processing (S5) and the display screen processing (S2) are also carried out for the special print format.

Hereafter, the special print format-selecting/designating processing (S7), as well as the character entry processing (S5) and the display screen processing (S2) involved therein will be described based on images of displays on the display screen similar to those shown in FIG. 7, and thereafter, the print image-forming processing (S9) for the special print format will be described.

Figure 8:
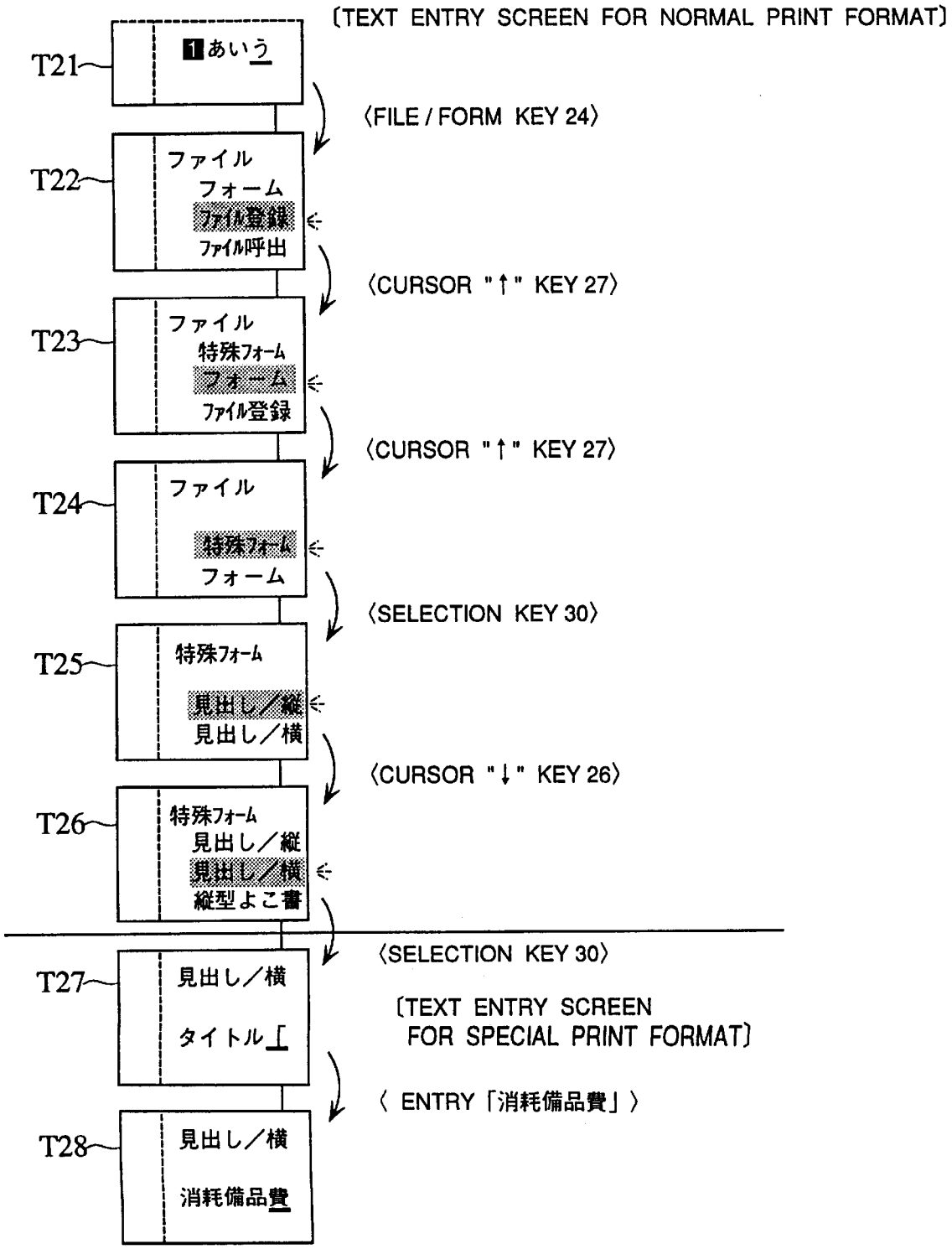
FIG. 8 is a diagram showing examples of displays on the display screen which are useful in explaining print format-selecting/designating processing of the FIG. 4 program.

Referring to FIG. 8, if the file/format key 24 is depressed when a text entry screen is displayed for the normal print format (screen T21, hereafter "screen" will be omitted), the handling of files and print format selection are enabled (T22). That is, by selecting one of displayed options of (1) SPCL, which represents "special format", (2) "FRMT", which represents "format", (3) "RGST" which means "file registration", (4) "CALL" , which means "file calling", (5) "RSTR", which represents "file deletion", and (6) "RSTR" which represents "file restoration", through operation of the cursor (↓) key 26 or the cursor (↑) key 27 to cause the selected one to be displayed in reverse video, and then depressing the selection key 30, the selected option in reverse video can be designated. If (2) "FRMT" (format) is selected, a normal print format can be selected for designation, and under the options of (3) to (6), respective file-handling operations can be carried out. Under the option (1) "SPCL" (special format), any of special print formats, which characterize the present invention, can be selectively designated.

As shown in FIG. 8, immediately after depression of the file/format key 24, the option of (3) "RGST" (file registration) is for selection by default (T22). By depressing the cursor (↑) key 27, the option (2) "FRMT" (format) is displayed in reverse video, and by further depressing the cursor (↑) key 27, the option (1) "SPCL" (special format) is displayed in reverse video (T24). If the selection key 30 is depressed in this state, this option is selected to enable various print formats of this kind to be selected (T25). A special print format is selected in this screen from the following options: (1) "IND/V" (Index/Vertical), (2) "IND/H" (Index/Horizontal), (3) "PT/HW" (Portrait/Horizontal writing), (4) "LS/VW" (Landscape/Vertical writing). The "IND/V" (Index/Vertical) print format is one for making a label for an index tab, in which characters are arranged in vertical writing. The "IND/H" (Index/Horizontal) print format is one for making a label for an index tab, in which characters are arranged in horizontal writing. The "PT/HW" (Portrait/Horizontal writing) print format is one for making a label in which character strings in horizontal writing are each arranged in a transverse direction of the tape T, while the "LS/VW" (Landscape/Vertical writing) print format is one for making a label in which character strings in vertical writing are arranged in the transverse direction of the tape.

To select the option (2) "IND/H (Index/Horizontal)", for example, by depressing the cursor (↓) key 26, the screen can be changed from its default state of the (1) "IND/V" (Index/Vertical) being in reverse video for selection, to a screen T26 in which the option "IND/H" (Index/Horizontal) is in reverse video for selection, and then by depressing the selection key 30 in this state, the text entry screen (T27) is displayed for the special print format of the "IND/H" (Index/Horizontal) print format. In this screen T27, as shown in FIG. 8, there is displayed "TITL[", which means "title[", for guiding text entry after the position of "[". If "消耗備品費" (consumable article expense) is entered, the character entry processing (S5) for the "IND/H" (Index/Horizontal) print format is carried out, similarly to the steps for the normal print format described hereinabove, i.e. the step of storing the entered text data in the text memory 61, et seq. Further, at the end of the text data, similarly to the normal print format, the Null data is arranged.

Now, an outline of the specifications of the four kinds of special print formats will be described with reference to FIGS. 9A to 12C.

First, under the "IND/V" (Index/Vertical) print format, as shown in a table shown in FIG. 9A, in the screen displaying the text entry guide of "TITL[", text data of ten or smaller number of characters can be entered after "[". For example, when 消耗備品費 (consumable article expense) is entered as shown in FIG. 9B1, a pair of character strings of the same contents 消耗備品費 (consumable article expense) are printed in axial symmetry with respect to a center line of the tape in parallel with each other in a longitudinal direction as indicated by an arrow, as shown in FIG. 9C1. (Hereinafter, a printed image on the tape T will be referred to by the use of reference numeral M??, and the image will be shown with the reference numeral.)

The character strings of "消耗備Z,10 (consumable article expense)" are printed in an area having a predetermined length, i.e. an area for a label for an ordinary index tab, which has a length of 4.5 cm (see FIG. 22), and a printed portion of the tape represented by the printed image Ma1 is cut off to form a label which is represented by a label image Ra1 in FIG. 9D1. (Hereinafter, similarly to the printed image, each label image of the portion cut off from the tape will be referred to by the use of reference numeral R??, and the label image will be shown with the reference numeral.)

Similarly, if "交通費" (commutation allowances) is entered after the entry guide of "TITL", a printed image Ma2 shown in FIG. 9C2 and a label image Ra2 shown in FIG. 9D2 are obtained. Further, when the "IND/V" (Index/Vertical) print format or the "IND/H" (Index/Horizontal) print format, described hereinafter with reference to FIGS. 10A to 10D7, is employed, the characters of each character string, e.g. "交(kou)", "通(tu)" and "費(hi)" of "交通費" (commutation allowances) can be arranged or laid out to form not only a label for an index tab in which the characters are equally spaced in the longitudinal direction of the label (e.g. as represented by a label image Ra2 of FIG. 9D2), but also a "centered character" label in which the characters are centered (e.g. as represented by a label image Ra3 of FIG. 9D3), a "forward-shifted character" label in which the characters are shifted forward (e.g. as represented by a label image Ra4 of FIG. 9D4), and a "backward-shifted character" label in which the characters are shifted backward (e.g. as represented by a label image Ra5 of FIG. 9D5).

Figure 22:
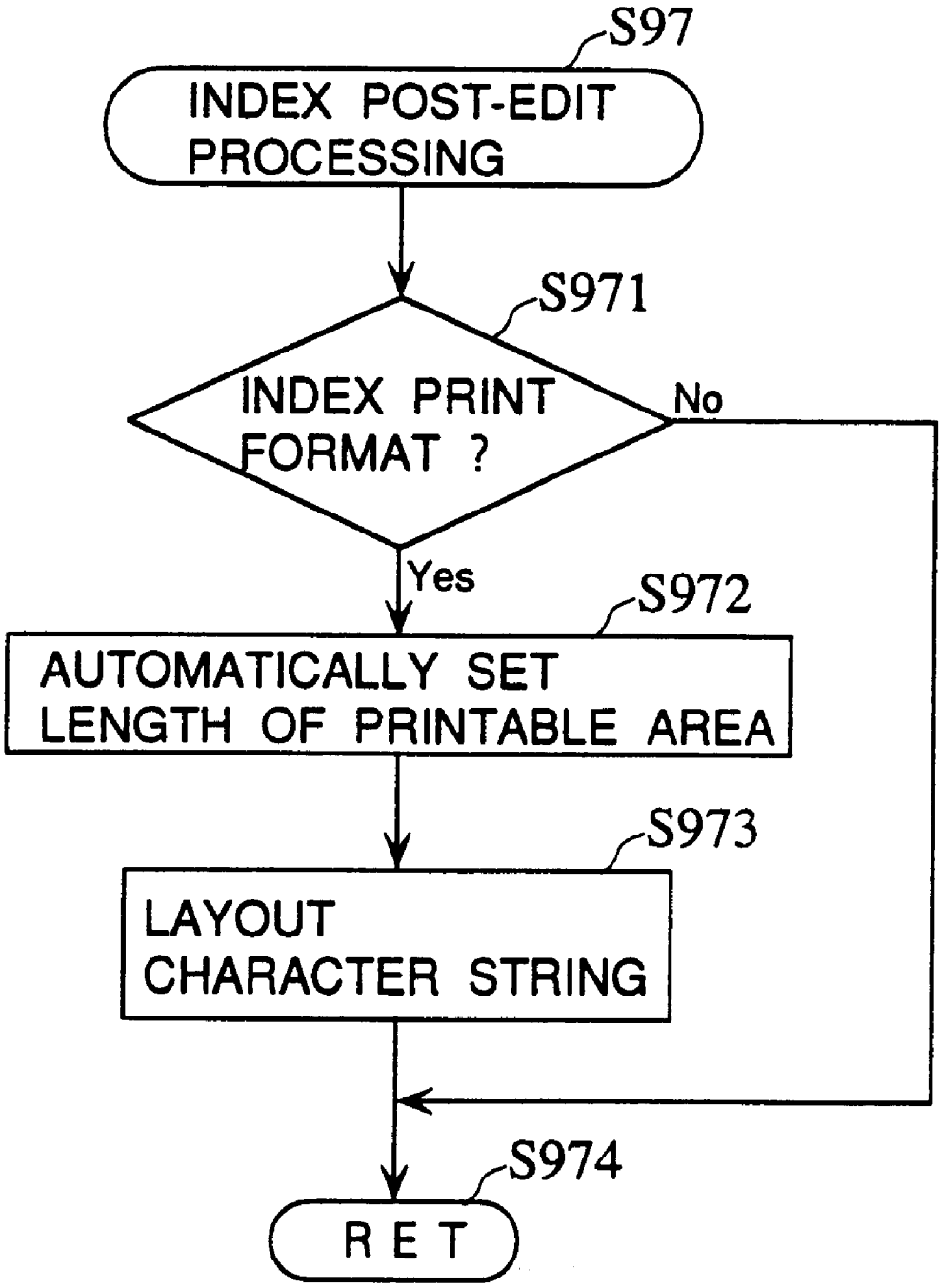
FIG. 22 is a flowchart showing a subroutine for index post-edit processing executed in the FIG. 13 routine.

The character layout can be selected, in a state of the display screen corresponding to the screen T28 in FIG. 8, by depressing the file/format key 24 again after completion of text entry, thereby displaying the same selection screen as the screen T26 in FIG. 8, and selecting a desired one of character layout options from this screen. This selection causes the selected character string arrangement to be set to a setting flag, whereby when character layout processing (S973) in index post-edit processing (S97), described hereinafter with reference to FIG. 22, is carried out, the characters of each string are arranged according to any of the selected character layout options. The default designation is an "equally-spaced layout" (employed for the label image Ra2).

FIGS. 10A to 10D7 show examples of the specifications of the "IND/H" (Index/Horizontal) print format and results of processing carried out when this print format is designated. If 消耗備品費 (consumable article expense), for example, is entered as shown in FIG. 10B1 when the text entry guide of "TITL[" is shown, the processing causes a pair of character strings of the same contents 消耗備品費 (consumable article expense) to be printed in horizontal writing in point symmetry with respect to a central point on a center line of a portion of the tape in the longitudinal direction thereof indicated by an arrow. The length of a printable area is automatically set similarly to the "IND/H" (Index/Horizontal) print format. If the resulting printed portion represented by an printed image Mb1 (FIG. 10C1) is cut off from the tape T, a label is obtained as represented by a label image Rb1 of FIG. 10D1. Other label images Rb2 to Rb5 (FIGS. 10D2 to 10D5) are similar to the label images Ra2 to Ra5 (of FIGS. 9D2 to 9D5) described above, respectively, and hence description thereof is omitted. Label images Rb6 and Rb7 shown in FIGS. 10D6 and 10D7 will be described hereinafter.

Figures 11A, 11B, 11C:
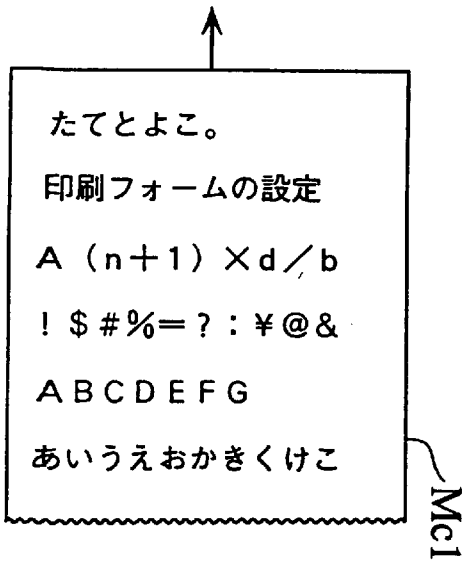
FIGS. 11A to 11C are diagrams which are useful in explaining a PT/HW (Portrait/Horizontal writing) print format as one of the special print formats.

Next, as shown in FIGS. 11A and 11B, when the "PT/HW" (Portrait/Horizontal writing) print format is designated, it is possible to enter text data of ten or smaller number of characters for each line in a screen showing the text entry guide of "L1[", which represents "first line[". Then, if "たてとよこ。" (ta te to yo ko .), which means "vertical and horizontal.", is entered for the first line, and the selection (settling) key 30 is depressed, the entry guide of "L2[", which represents "second line[", appears on the following line, enabling entry of text data for the second line, similarly to the first line.

FIG. 11B shows an example of an entry of text data of the same contents as entered for the normal print format described above with reference to FIG. 6D, for comparison of the two print formats. Compared with a printed image of FIG. 6E in horizontal writing obtained from the FIG. 6D text, in which character strings in horizontal writing are each arranged in the longitudinal direction of the tape, FIG. 11C shows a printed image Mc1 in which character strings in horizontal writing are each arranged in the transverse direction of the tape T, i.e. in a direction perpendicular to the direction of feeding (indicated by an arrow) of the tape T. Further, in illustrated examples of entry for the third, fourth, and sixth lines, "]" is automatically added at the end of text when a tenth character is entered, whereby an entry guide for the following line appears without depressing the selection key 30. In the present embodiment, as shown in FIG. 11A, the maximum 32 lines can be entered as text data.

Finally, referring to FIGS. 12A to 12D, when the "LS/VW" (Landscape/Vertical writing) print format is selected, it is possible to enter text data of ten or smaller number of characters for each line in a screen showing the text entry guide of "L1[". After entering ten characters or by depressing the selection key 30, the entry guide of "L2[" for the second line appears on the following line, and similarly thereafter, text entry can be carried out in a manner similar to that carried out under the "PT/HW" (Portrait/Horizontal writing) option as described with reference to FIGS. 11A to 11C. In illustrated examples of FIGS. 12A to 12D as well, the text data of the same contents as entered for the normal print format described above with reference to FIG. 6D is entered. Compared with a printed image of FIG. 6F in which character strings in vertical writing are each arranged in the longitudinal direction of the tape, FIG. 12C shows a printed image Md1 in which the character strings in vertical writing are each arranged long in the transverse direction of the tape T, i.e. in the direction perpendicular to the direction of feeding (indicated by an arrow) of the tape T.

Figure 13:
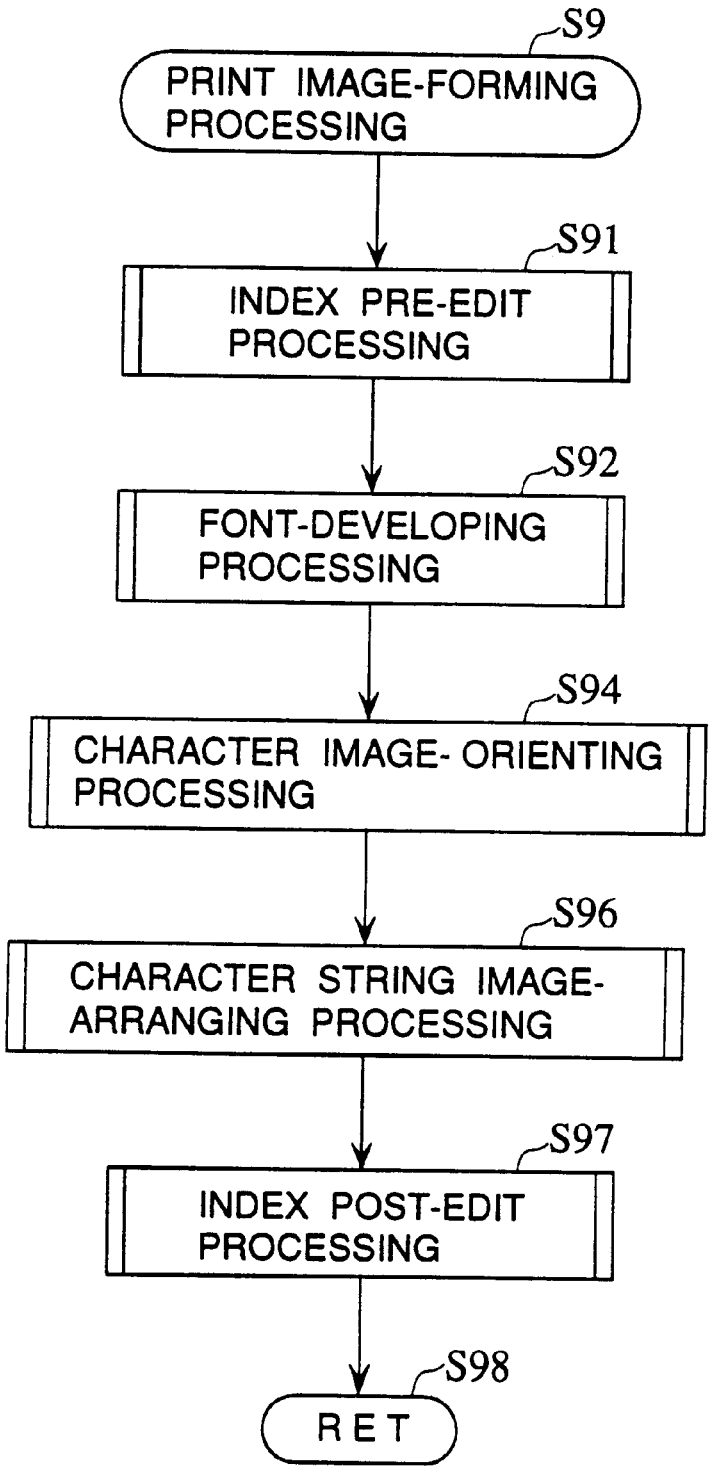
FIG. 13 is a flowchart showing a routine for print image-forming processing executed in the FIG. 4 program.

Next, the print image-forming processing (S9 in FIG. 4) will be described. This processing is started by depressing the print key 29. Referring to FIG. 13, when this processing is started, first at a step S91, index pre-edit processing is carried out at a step S91, and then font-developing processing at a step S92, character image-orienting processing at a step S94, character string image-arranging processing at a step S96, and the index post-edit processing at a step S97, followed by terminating the routine.

Now, the above processing steps will be described in detail based on examples. More specifically, the following description is made of examples of text data entries shown in a table of FIG. 15 which are selected from the examples of text data entries described with reference to FIGS. 9A to 12D, assuming that data based on the text data entries has been obtained by the character entry processing (S5).

Figure 14:
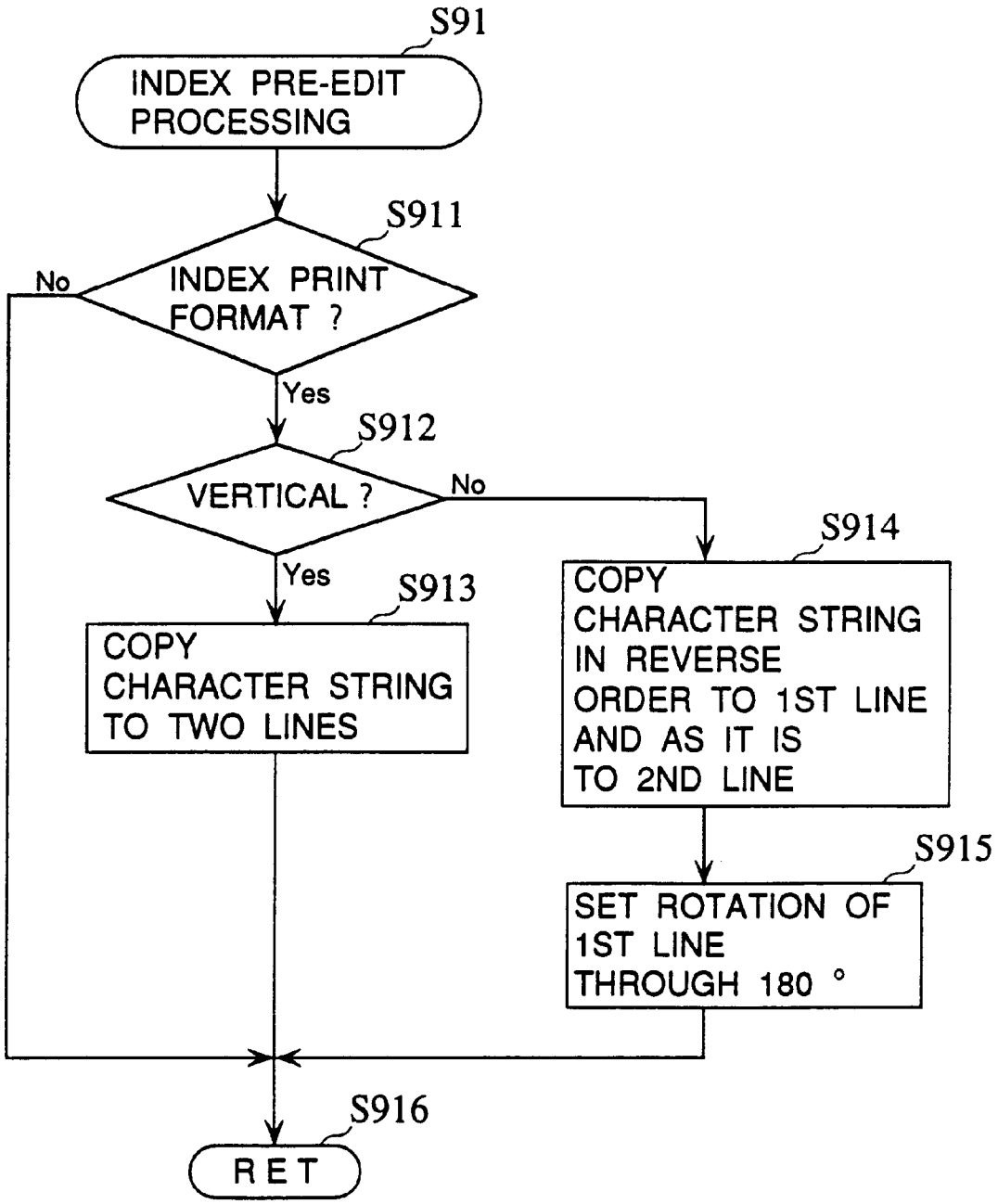
FIG. 14 is a flowchart showing a subroutine for index pre-edit processing executed in the FIG. 13 routine.

Referring to FIG. 14, when the index pre-edit processing is started, first, it is determined at a step S911 whether or not the selected format is an index print format. If the designated format is other than the index print format i.e. neither the "IND/V" (Index/Vertical) print format nor or the "IND/H" (Index/Horizontal) print format, described above, i.e. the answer to the question of the step S911 is negative (No), the present subroutine is immediately terminated.

If the "IND/V" (Index/Vertical) print format has been designated, the answer to the question of the step S911 is affirmative (Yes), and it is determined at a step S912 the selected index print format is a vertical writing type, i.e. the "IND/V" (Index/Vertical) print format. Then, the character string of "交通費" (commutation allowances) is copied to two lines to prepare text data Ua1 shown in the FIG. 15 table at a step S913, followed by terminating the subroutine (S916). (Hereinafter, text data arranged according to image data to be formed is referred to by the use of reference numeral U??, and shown with the reference numeral.)

When the "IND/H" (Index/Horizontal) print format is designated, it is determined at the step S911 that an index print format is designated (Yes to S911), and it is determined at the step S912 that the designated index print format is not a vertical writing type (No to S912). Then, the character string of "交通費" (commutation allowances) is copied to a first line after reversing the order of the characters, i.e. as "費通交", and to a second line as it is or in the original order of the characters to prepare text data Ub1 shown in the FIG. 15 table at a step S914. Then, the first line is rotated through 180 degrees at a step S915, followed by terminating the subroutine (S916).

Thus, when the index pre-edit processing (S91) is finished for each character entered, there are formed text data items Ua1, Ub1, Uc1, and Ud1 as shown on the right column of the FIG. 15 table, when the "Index/Vertical" print format, the "Index/Horizontal" print format, the "Portrait/Horizontal writing" print format, and the "Landscape/Vertical writing" print format, are designated, respectively.

Figure 16:
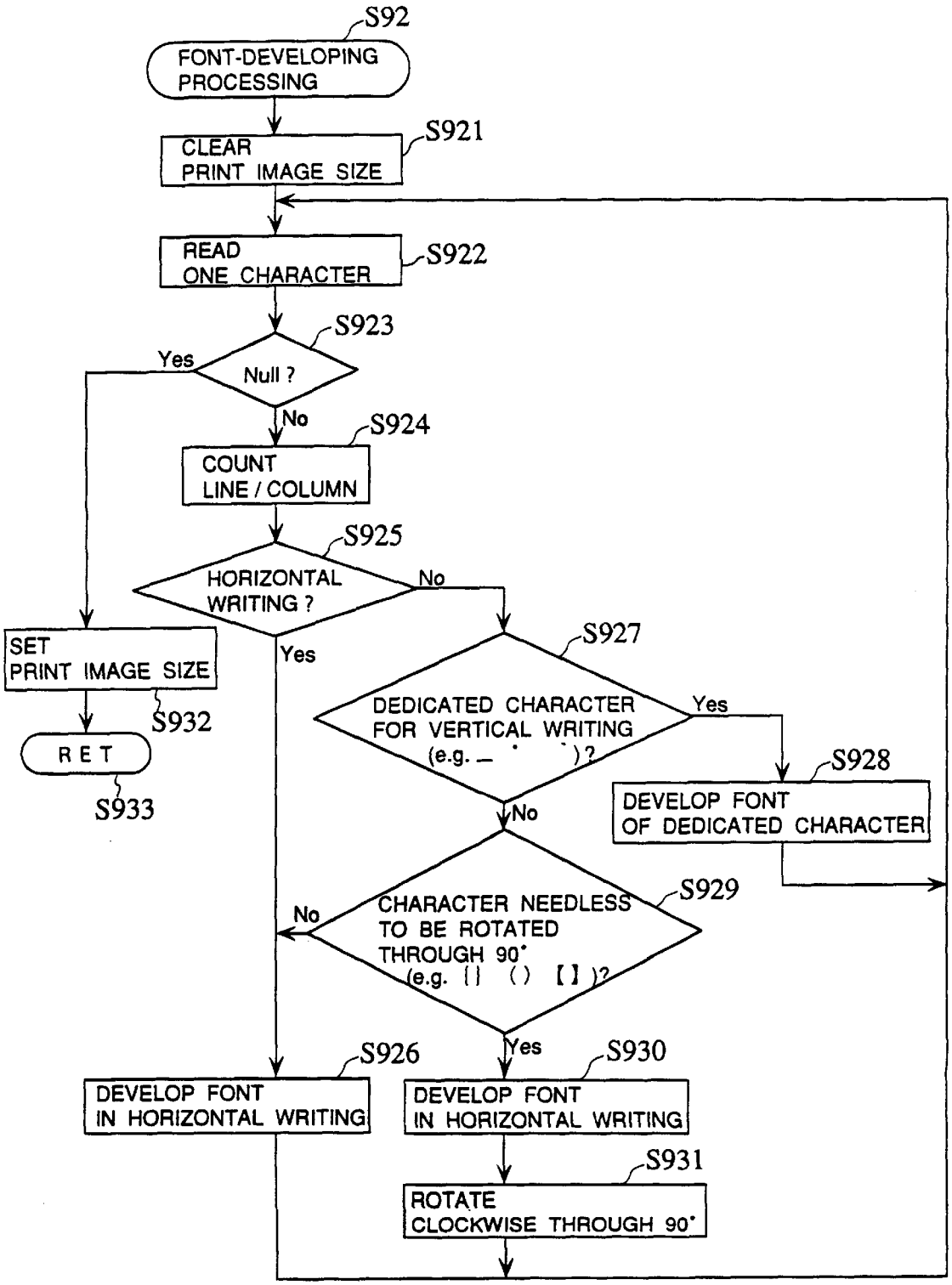
FIG. 16 is a flowchart showing a subroutine for font-developing processing executed in the FIG. 13 routine.

Next, referring to FIG. 16 when the font-developing processing (S92 in FIG. 13 is started based on text data of any of Ua1 to Ud1 entered, a print image size used on the immediately preceding occasion is cleared at a step S921. The image size-clearing processing initializes variables used for counting the number of lines (S924) and determining the size of a print image (S932).

When the print image size is cleared, data for a first character on a first line of text data examples of which are shown in the FIG. 15 table is read at a step S922, and it is determined at a step S923 whether or not the read data is the Null data. As described hereinabove, the Null data is arranged at the end of each text. If the Null data is read (Yes to S923), the setting of the print image size is carried out at a step S932, and the subroutine is terminated (S933). However, if the Null data is read as data for the first character on the first line, it implies that the text data entry (character entry) or the index pre-edit processing (S91) is not properly carried out, so that an error handling processing is carried out by an interrupt, not shown, whereby the whole print image-forming processing is abnormally terminated.

If the read data is not the Null data (No to S923), the numbers of lines and columns are counted at the step S924. That is, a variable for use in counting the number of lines, which is initialized to zero by the print image size-clearing processing, is counted up to 1, and thereafter, whenever a code for feeding a line is read, this variable is incremented by one. Further, to count the number of columns, there are employed a variable which is incremented by one whenever ordinary character data, such as data of a letter or the like, is read, and a variable which is updated by comparing a value of the number of characters obtained upon line-feeding and a value of the same stored, and holding or storing the larger one of the newly-obtained value and the stored value. By the use of the two variables, the number of characters on a line formed by the largest number of characters of text data, i.e. the number of characters of the longest line is held or stored. When all the characters in the text data are read, i.e. when the Null data at the end of the text data is read, the number of lines and columns of the total text data can be obtained, whereby the size of print image data for storing the characters can be determined and set at the step S932.

After completing the counting of lines and columns (S924), it is determined at a step S925 whether or not the designated print format is a print format for horizontal writing. When the print format for horizontal writing, i.e. the horizontal writing print format in the case of a normal print format, and the "IND/H" (Index/Horizontal) print format or the "PT/HW" (Portrait/Horizontal writing) in the case of a special print format, is designated (Yes to S925), font data corresponding to the read character is read from the CG-ROM 70 and developed as image data at a step S926. The development of font data in horizontal writing (S926) is carried out on all the characters of the text data by the loop processing from the reading of one character (S922) to the development of font data in horizontal writing (S926) whereby image data of developed font data of characters in horizontal writing is obtained.

For example, when the font data-developing processing (S92) is carried out on the text data Ub1 for the "IND/H" (Index/Horizontal) print format or the text data Uc1 for the "PT/HW" (Portrait/Horizontal writing) print format out of the text data items Ua1 to Ud1 on the central column of FIG. 17 table (identical to the right column of the FIG. 15 table), there is obtained image data Gb1 in which font data corresponding to the text data Ub1 is developed as it is or image data Gc1 in which font data corresponding to the text data Uc1 is developed as it is. (Hereafter, each item of image data is referred to by the use of reference numeral of "G??" and shown with the reference numeral.)

On the other hand, referring again to FIG. 16, if it is determined at the step S925 that the designated print format is a print format for vertical writing (No to S925), i.e. if the vertical writing print format in the case of a normal print format or if the "IND/V" (Index/Vertical) print format or the "LS/VW" (Landscape/Vertical writing) print format in the case of a special print format is designated, it is determined at a step S927 whether or not the read character is a dedicated character for vertical writing, i.e. a character dedicatedly used for vertical writing.

The dedicated character for vertical writing includes the last character "。" of the first line "たてとよこ。 (ta te to yo ko .)" and "ォ" and "ー" of the second line "フォーム" (format) of the text data Ud1 on the central column at the lowest row of the FIG. 17. That is, the character of this kind is a kind of character which specifically uses a different type of font data for vertical writing from one for horizontal writing to express the same contents or meaning. If the character read at the step S922 is a dedicated character for vertical writing (Yes to S927), font data for the dedicated character is read and developed into image data (S928), and then the following character is read (S922).

If it is determined at the step S927 that the read character is not a dedicated character for vertical writing (No to S927), it is determined at a step S929 whether the read character is a character which need not be rotated through 90 degrees. The character which should be rotated through 90 degrees, i.e. which should be oriented in the same direction even the print format is changed from a print format for horizontal writing into a print format for vertical writing, includes parentheses, i.e. "(" and ")" of the third line and "=" of the fourth line of the text data Ud1 of the FIG. 17 table. If it is determined that the read character belongs to this kind of character "Yes to S929", after execution of development of font data in horizontal writing at a step S930, the developed image data is rotated in advance through 90 degrees in a clockwise direction, i.e. in an opposite direction to a counterclockwise direction, since all the characters in the print format for vertical writing are to be uniformly rotated through 90 degrees in the counterclockwise direction (at a step S947 in FIG. 18) in the character image-orienting processing (S94) described in detail hereinafter with reference to FIG. 18. Then, the program returns to the step S922, where the following character is read.

On the other hand, if the read character does not belong to any of the above-mentioned kinds (No to S927, and at the same time No to S929), the development of font data in horizontal writing is carried out on the character at a step S926 in the same manner as carried out on data for horizontal writing, and then the program returns to the step S922.

The above processing is repeatedly carried out on all the characters of the text data, whereby image data having font data developed for vertical writing is formed. For example, when the development of font data in vertical writing is carried out on the text data Ua1 or Ud1 shown in the FIG. 17 table, image data Ga1 or Gd1 shown on the right column of the same table is obtained.

Next, the character image-orienting processing (S94 in FIG. 13) carried out on image data examples of which are represented by Ga1 to Gd1 will be described with reference to FIG. 18. First, image data for one character is read at a step S941, and the counting of the number of read characters is carried out to know what number of line and what number of column the read character belongs to. When the number of line and the number of column obtained by this step agrees with the values of the print image size determined at the step S932 in the font data-developing processing (S92) in FIG. 16, it is determined at a step S948, referred to hereinafter, that the present processing has been carried out on the image data items of all the characters, followed by the terminating the subroutine (S949).

After the numbers of lines and columns of image data are counted at the step S942, it is determined at a step S943 whether or not a print format for horizontal writing is designated. If the print format for horizontal writing is designated (Yes to S943), then it is determined at a step S944 whether or not the designated print format is a print format for an index tab. If the print format for an index tab is not designated (No to S944), i.e. if it is determined that the "見出し/横" (Index/Horizontal) print format is not designated, it is determined at the step S948 whether or not the processing has been carried out on the image data items of all the characters. If the processing has been carried out on the image data items of all the characters (Yes to S948), the present processing is terminated at the step S949.

For example, when the character image-orienting processing (S94) is carried out on image data in a print format for horizontal writing but not in a print format for an index tab, for example, on the image data Gc1 in the "PT/HW" (Portrait/Horizontal writing) out of the image data items Ga1 to Gd1 of the central column of the FIG. 19 table (identical to those shown in the right column of the FIG. 17 table), image data Gc2 as shown in the right column of FIG. 19 is formed which is a mere copy of the image data Gc1 as input data.

On the other hand, if the print format for horizontal writing is designated (Yes to S943), and at the same time the print format for an index tab is designated (Yes to S944), i.e. if the "IND/H" (Index/Horizontal) print format is designated, it is determined at a step S945 whether or not the read character image data belongs to the first line. If the read character image data belongs to the first line (Yes to S945, the read character image data is rotated through 180 degrees at a step S946 according to the setting therefor effected at the step S915 of the index pre-edit processing (S91) described hereinabove with reference to FIG. 14. If the read character data does not belong to the first line (No to S945), it is outputted as it is. Then, it is determined at the step S948 whether or not the processing has been carried out for the image data items of all the entered characters. If the processing has been carried out for the image data items of all the entered characters (Yes to S948), the present processing is terminated (S949).

For example, when the character image-orienting processing (S94) is carried out on the image data Gb1 in the "IND/H" (Index/Horizontal) print format of the FIG. 19 table, each character image data item of the character string image data of "費通交" of the first line is rotated through 180 degrees to thereby form data of the same character string (though in an inverted form) of "交通費" in horizontal writing which is in point symmetry to the "交通費" of the second line. As a result, the character image-orienting processing outputs image data Gb2 of two character string images of the same contents "交通費" arranged in point symmetry.

Figure 18:
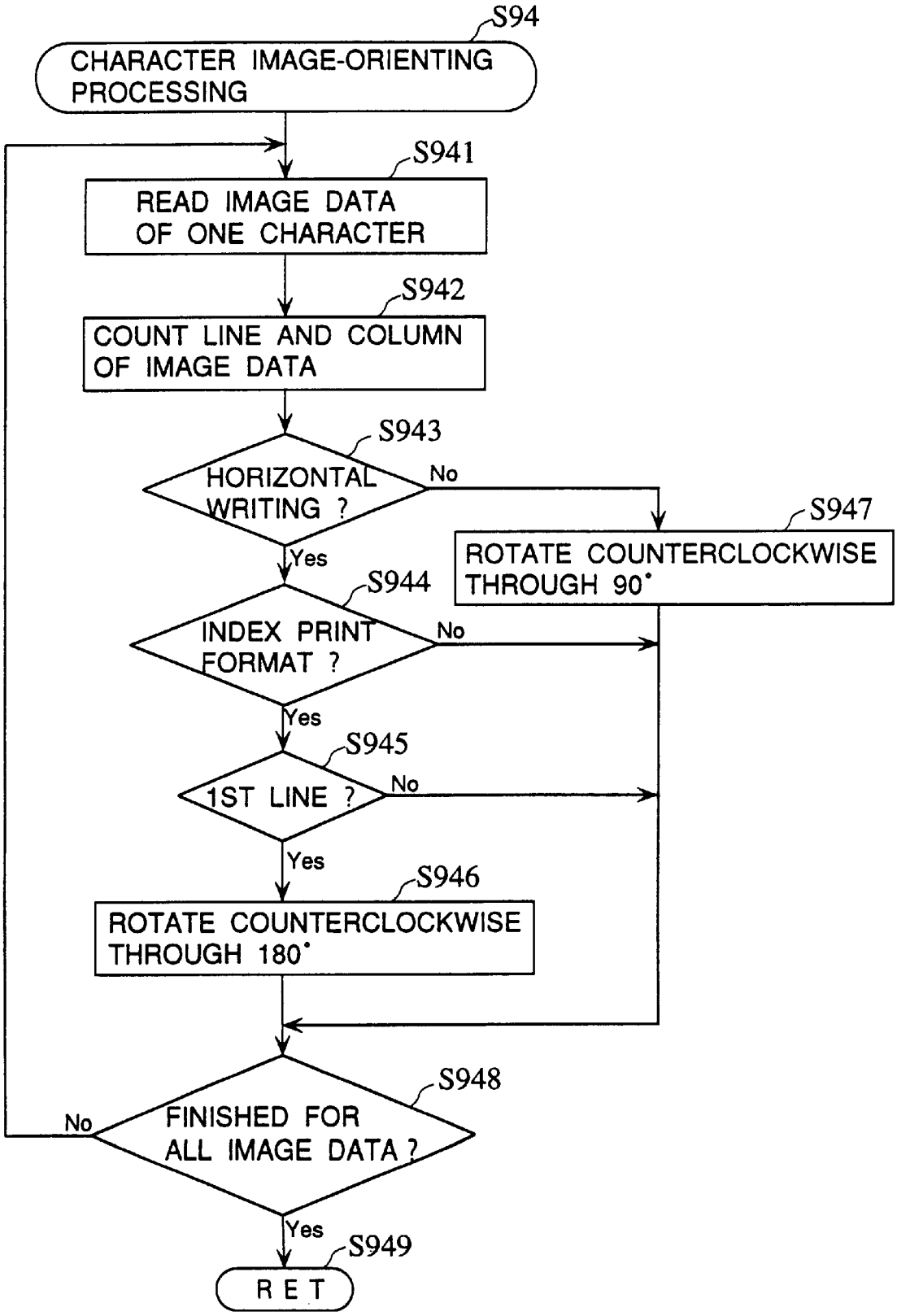
FIG. 18 is a flowchart showing a subroutine for character image-orienting processing executed in the FIG. 13 routine.

If it is determined at the step S943 in FIG. 18 that a print format for horizontal writing is not designated (No to S943), i.e. if a print format for vertical writing is designated, the read character image is rotated through 90 degrees in a counterclockwise direction at a step S947, and then it is determined at the step S948 whether or not the processing has been carried out on the character image data items of all the entered characters. If the processing has been carried out on the character image data items of all the entered characters, the processing is terminated.

For example, when the character image-orienting processing (S94) is carried out on the image data Ga1 in the "IND/V" (Index/Vertical) print format or the image data Gd1 in the "LS/VW" (Landscape/Vertical writing) print format of the central column of the FIG. 19 table, image data Ga2 or Gd2 shown in the right column of FIG. 19 in which each character image data item (i.e. image data of each character) has been rotated through 90 degrees in a counterclockwise direction is obtained.

Next, the character string image-arranging processing (S96) carried out based on oriented image data examples of which are represented by Ga2 to Gd2 will be described with reference to FIG. 20. In this processing, first, it is determined at a step S961 whether or not the character strings should extend along the length of the tape, i.e. in the longitudinal direction of the tape. If the character strings should extend along the length of the tape (Yes to S961), i.e. if the image data is in the "IND/V" (Index/Vertical) print format or the "IND/H" (Index/Horizontal) print format for a label for an index tab or in the normal print format, the image data of the character strings is arranged in the longitudinal direction of the tape at a step S962, followed by terminating the processing (S964). On the other hand, if the character strings should not extend in the longitudinal direction of the tape (No to S961), i.e. if the image data is in the "PT/HW LS/VW" (Portrait/Horizontal writing) print format or the "LS/VW" (Landscape/Vertical writing) print format, the image data of the character strings is arranged along the width of the tape i.e. in the transverse direction of the tape at a step S963, followed by terminating the processing (S964).

For example, assuming that a vertical (top - bottom) direction of the images as viewed in FIG. 21 is the transverse direction of the tape, and a horizontal (left - right) direction of the images as viewed in the same is the longitudinal direction of the tape, the character string image-arranging processing (S96) carried out on the image data Ga2 in the "IND/V" (Index/Vertical) print format or the image data Gb2 in the "IND/H" (Index/Horizontal) print format out of the image data items Ga2 to Gd2 in the FIG. 21 table (identical to those on the right column of the FIG. 19 table) gives image data Ga3 or Gb3 which is formed by merely copying the image data Ga2 or Gb2 as input data as shown in the right column of the FIG. 21 table. On the other hand, if the same processing (S96) carried out on the image data Gc2 in the "PT/HW" (Portrait/Horizontal writing) print format or the image data Gd2 in the "LS/VW" (Landscape/Vertical writing) print format gives image data Gc3 or Gd3 which is obtained by rotating the whole image data Gc2 or Gd2 through 90 degrees in a counterclockwise direction.

Next, the index post-edit processing (S97) carried out on the image data items Ga3 to Gd3 will be described with reference to FIG. 22. First, it is determined at a step S971 whether or not the image data is for a label for an index tab, i.e. in an index print format. If the image data is not for a label for an index tab (No to S971), that is, if the image data is neither in the "IND/V" (Index/Vertical) print format nor in the "IND/H" (Index/Horizontal) print format, the processing is immediately terminated.

For example, the index post-edit processing carried out on image data in a print format which is not used for making a label for an index tab, i.e. the image data Gc3 in the "PT/HW" (Portrait/Horizontal writing) print format or the image data Gd3 in the "LS/VW" (Landscape/Vertical writing) print format out of the image data items Ga3 to Gd3 in the FIG. 23 table (identical to those on the right column of the FIG. 21 table) gives image data Gc4 or Gd4 which is formed by merely copying the image data Gc3 or Gd3 as input data, as shown in the right column of the FIG. 23 table.

On the other hand, if it is determined that the image data is for a label for an index tab (Yes to S971), i.e. if the image data is in the "IND/V" (Index/Vertical) print format or the "IND/H" (Index/Horizontal) print format, the length of a printable area is automatically set to a predetermined value for the index tab at a step S972, and an image data area corresponding to the length value thus set is allocated to the image data. Then, each character image data item of the character string data is laid out in the area at a step S973, followed by terminating the processing (S974).

For example, the index post-edit processing carried out the image data Ga3 in the "IND/V" (Index/Vertical) or the image data Gb3 in the "IND/H" (Index/Horizontal) print format gives image data Ga4 or Gb4 in which the characters of the character string "交通費" are uniformly allocated to the area of the image data for the label for the index tab at uniformly-spaced intervals to thereby decrease the forward and backward margins for the character string, as shown in the right column of the FIG. 23 table, when the equally-spaced layout is designated by default.

Then, when the printing processing is carried out at the step S10 in FIG. 4 e.g. based on one of the image data items Ga4 to Gd4 as print image data, they are printed to form the printed images shown in FIGS. 9A to 12D with reference to which the related description is made hereinabove. That is, when the "IND/V" (Index/Vertical) print format is designated, the printed image Ma2 in FIG. 9 is obtained. When the "IND/H" (Index/Horizontal) print format is designated, the printed image Xb2 in FIG. 10 is obtained. When the "PT/HW" (Portrait/Horizontal writing) print format is designated, the printed image Mc1 in FIG. 11 is obtained. When the "LS/VW" (Landscape/Vertical writing) print format is designated, the printed image Md1 in FIG. 12 is obtained.

As described heretofore, the tape printing apparatus 1 according to the embodiment of the present invention has several kinds of print formats ready for use. Print image data is formed by editing and arranging character strings based on a designated one of the print formats, and printing is carried out based on the print image data thus formed. The print format includes not only normal print formats (first print format group) such as a vertical writing print format and a horizontal writing print format for printing character strings in the longitudinal direction of the tape which have been employed by conventional tape printing apparatuses, but also special print formats (second print format group) including the "IND/V" (Index/Vertical) print format and the "IND/H" (Index/Horizontal) print format for making a label for a index tab as well as the "PT/HW" (Portrait/Horizontal writing) print format and the "LS/VW" (Landscape/Vertical writing) print format for printing character strings in the transverse direction of the tape.

In other words, the tape printing apparatus 1 has various print formats ready for use, which meet needs of users, such as print formats for printing character strings arranged in a direction other than the longitudinal direction of the tape (the "PT/HW" (Portrait/Horizontal writing) print format and the "LS/VW" (Landscape/Vertical writing) print format), print formats for printing character strings arranged in respective predetermined areas (the "IND/V" (Index/Vertical) print format and the "IND/H" (Index/Horizontal) print format), print formats for printing characters after orienting characters in a direction different from a direction originally set for the characters (the vertical writing print format, the "IND/V" (Index/Vertical) print format, the "IND/H" (Index/Horizontal) print format, the "PT/HW" (Portrait/Horizontal writing) print format, and the "LS/VW" (Landscape/Vertical writing) print format), whereby the apparatus is capable of printing on an identical tape-shaped recording medium in various forms, and the resulting printed portions are cut off to form labels suitable for various uses.

Further, the present apparatus is capable of using normal print formats (first print format group) conventionally employed for printing ordinary character strings and special print formats (second print format group) as described hereinabove as two completely separate and distinguished groups of formats, whereby the present apparatus preserves upward compatibility with conventional tape printing apparatuses. As a result, the present apparatus can be easily accepted by users familiar with conventional apparatuses.

Still further, when the print formats for making labels for index tabs, such as the "IND/V" (Index/Vertical) print format and the "IND/H" (Index/Horizontal) print format, are designated, the length of a printable area is automatically set according to the index tab, and image data of each character can be arranged according to the length of the printable area to thereby carry out printing in a manner suitable for the index tab. This makes it possible to save the trouble of setting the length of a printable area and properly arranging the characters. The printed portion thus formed and cut off from the tape provides a label for an index tab having an enhanced appearance.

Figure 24A:
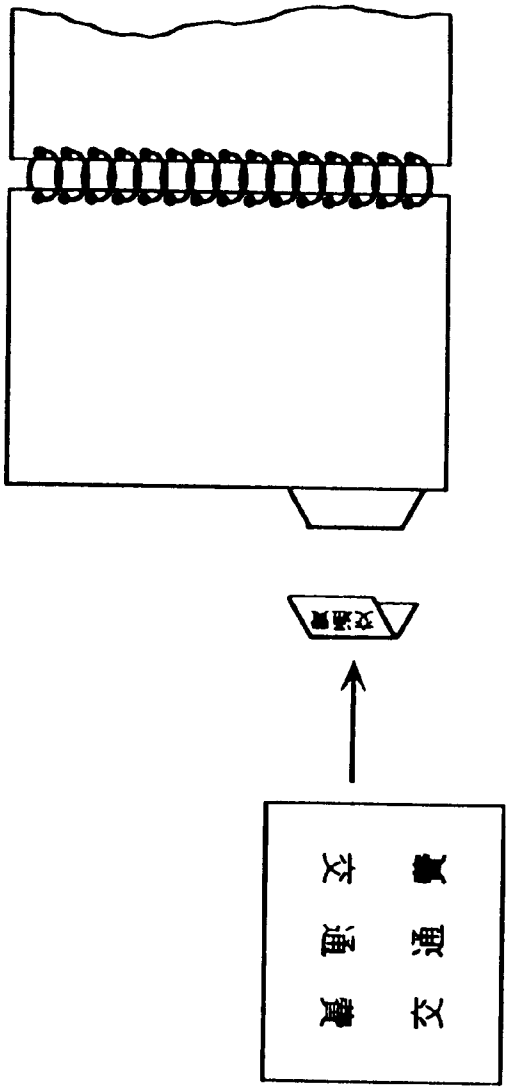
FIGS. 24A and 24B show examples of results of printing carried out using special print formats.
Figure 24B:
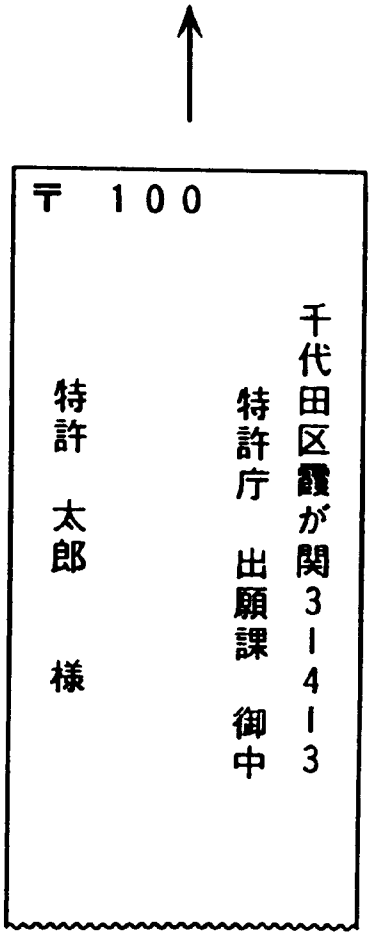

Further, in the case of print formats for making a label for an index tab, character strings having the same contents in vertical writing or horizontal writing are printed on both sides of a center line of the tape T (recording medium) along the length thereof. The label thus formed can be bent along the center line as shown in FIG. 24A, so that it is possible to easily form index tabs printed with character strings (e.g. "交通費 (commutation allowances)" formed of the same letters and/or symbols on both sides thereof. As a result, it is possible to save the labor and time of pasting or sticking a pair of separate labels to each other.

Further, the "PT/HW" (Portrait/Horizontal writing) print format and the "LS/VW" (Landscape/Vertical writing) print format enable character strings in horizontal writing and vertical writing to be printed in the transverse direction of the tape T (recording medium). This makes it possible to print a postal code (e.g. "〒100") in horizontal writing by the use of the Portrait/Horizontal writing print format and then an address and a name (e.g. "千代田区霞ヶ関 . . . " (Chiyoda-ku Kasumigaseki . . . ) and "特許太郎様" (Mr. Taro Tokkyo) in vertical writing arranged along the length of the tape in a conventional manner to thereby form a label in which character strings in vertical writing and horizontal writing are longitudinally and transversely arranged in a mixed manner, which cannot be carried out by conventional tape printing apparatuses.

Further, when the "PT/HW" (Portrait/Horizontal writing) print format is designated, it is possible to print a composition of a number of lines each formed by a relatively small number of letters, such as lyric lines, haiku, and waka, in a single label, which cannot be effected by conventional tape printing apparatuses, either. Therefore, the present apparatus saves the extra effort and time for forming a plurality of labels separately and affixing each of them through accurate positioning effected such that neat and uniform space is provided between each adjacent pair of lines.

The invention is not necessarily limited to the embodiment described above, but can be put into practice in the form of variations and modifications thereof.

For example, although in the "IND/H" (Index/Horizontal) print format, the first line of text data is rotated through 180 degrees whereby the character strings are arranged such that the characters forming the strings have their top sides positioned closer to the center line, this is not limitative but the second line of the text data may be rotated whereby the character strings may be arranged such that the characters forming the strings have their bottom sides positioned closer to the center line, or further, an additional print format for such arrangement may be provided for selection according to the use of a label.

Further, for the "IND/H" (Index/Horizontal)print format, a variation is possible in which the character layout processing (S973) in the index post-edit processing (S97) in FIG. 22 can designate "single forward side-shifted arrangement" or "single backward side-shifted arrangement" in which, as shown in the label images Rb6 and Rb7 in FIGS. 10D6 and 10D7, the character strings are arranged in respective positions shifted forward and backward with respect to a direction of the character string on the lower side. These two kinds of layout method provides printed portions which, when cut off as they are, form labels identical in layout. However, if they are used in combination of other print formats, e.g. if the label image Rb6 in FIG. 10D6 is printed after the label image Ra5 in FIG. 9D5, or the label image Rb7 in FIG. 10D7 is printed before the label image Ra4 in FIG. 9D4, a printed portion obtained thereby can be cut off to form a label which can be read not only vertically but also horizontally. Such an elaborately formed label can be formed by the present apparatus.

The length of a printable area set by the "IND/V" (Index/Vertical) print format and the "IND/H" (Index/Horizontal) print format can be set differently from the step S972 for automatic setting of the length of the printable area in the index post-edit processing in FIG. 22, such that it can be set to a desired length other than 0.45 cm.

The specification of the "PT/HW" (Portrait/Horizontal writing) print format shown in FIG. 12A may be set such that, as shown in the printed image Md2 in FIG. 12D, printing is started with the last line of the text. This manner of printing can be set by modifying the processing at the step S963 in FIG. 20 of the character string image-arranging processing (S96) such that the image data Gd2 in the FIG. 21 table is rotated clockwise through 90 degrees.

Further, although in the four kinds of special print formats the specifications of which are shown in FIGS. 9A, 10A, 11A, and 12A, ten or smaller number of characters can be printed per line, this is not limitative, but this setting can be modified as desired depending the type of tape as a recording medium and the performance of the thermal head, or locations where labels are to be placed or use of them. Further, although in the overall flow of processing shown in FIG. 4, whenever key entry is effected, it is sequentially determined which of the function keys of each function key group is depressed, this is not limitative, but the system may be configured such that depression of each function key generates a specific interrupt, and in response thereto interrupt-handing processing is carried out.

Further, the tape printing apparatus can be provided with various kinds of alarming functions. It is preferred that alarms may be produced not only when the remaining portion of the tape for printing has a smaller length than required, or the tape is deformed due to mechanical causes to make it impossible to carry out printing, etc., but also according to limits on text entry, i.e. on the number of lines, the number of characters, depending on the kind of tape and the kind of print format. That is, when there are such limits set on text entry, an alarm may be produced at a time of an entry exceeding any of the limits, or alternatively, text entry per se is permitted but an alarm is raised when the print key 29 is depressed if the entered text exceeds any of the limits.

The alarming can be effected by sounds, such as beeps, warning messages displayed on the display screen 9*a* of the liquid crystal display 9, etc. Further, for the limits of the number of lines and the number characters which can be entered, there may be displayed, at the end of each line or the end of the last printable line displayed on the display screen 9*a,* an END mark indicative of such a limit position, or a line indicative of the boundary of a printable area, to thereby make the user conscious of the number of remaining lines and characters which can be entered.

It is further understood by those skilled in the art that the foregoing are preferred embodiments of the invention, and that various changes and modification may be made without departing from the spirit and scope thereof.

What is claimed is:

1. A tape printing apparatus, comprising:

print format-designating means for selecting one kind of print format as a designated print format, from a plurality of kinds of print formats, each print format corresponding to instructions initially stored in a memory;

entry means for arranging entered characters to form a character string;

print image-forming means for forming print image data by editing said character string based on the instructions for said designated print format;

printing means for printing on a recording medium in the form of a tape being fed, based on said print image data, means for arranging said characters of said character string in a direction other than a longitudinal direction of said recording medium in the form of a tape; and changing an orientation of each of said characters in a direction different from an orientation thereof originally set in said character string.

2. A tape printing apparatus according to claim 1, wherein said plurality of print formats are grouped into a first print format group including a vertical writing print format for printing by making a lateral direction of said each character in agreement with a transverse direction of said recording medium in the form of a tape and arranging said each character in said longitudinal direction of said recording medium in the form of a tape, and a horizontal writing print format for printing by making a vertical direction of said each character of said character string in agreement with said transverse direction of said recording medium in the form of a tape and arranging said each character in said longitudinal direction of said recording medium in the form of a tape, and a second print format group including other print formats than said vertical writing print format and said horizontal writing print format.

3. A tape printing apparatus according to claim 2, wherein said plurality of print formats include a portrait horizontal writing print format, and wherein when said portrait horizontal writing print format is selected as said designated print format, said print image-forming means forms said print image data by making a lateral direction of character image data corresponding to said each character of said character string in agreement with a direction corresponding to said transverse direction of said recording medium in the form of a tape, and arranging said character image data in said transverse direction of said recording medium in the form of a tape.

4. A tape printing apparatus according to claim 2, wherein said plurality of kinds of print format include a landscape vertical writing print format, and wherein when said landscape vertical writing print format is selected as said designated print format, said print image-forming means forms said print image data by making a vertical direction of character image data corresponding to said each character of said character string in agreement with a direction corresponding to said transverse direction of said recording medium in the form of a tape, and arranging said character image data in said transverse direction of said recording medium in the form of a tape.

5. A tape printing apparatus according to claim 1, wherein said plurality of print formats include a portrait horizontal writing print format, and wherein when said portrait horizontal writing print format is selected as said designated print format, said print image-forming means forms said print image data by making a lateral direction of character image data corresponding to said each character of said character string in agreement with a direction corresponding to a transverse direction of said recording medium in the form of a tape, and arranging said character image data in said transverse direction of said recording medium in the form of a tape.

6. A tape printing apparatus according to claim 1, wherein said plurality of kinds of print format include a landscape vertical writing print format, and wherein when said landscape vertical writing print format is selected as said designated print format, said print image-forming means forms said print image data by making a vertical direction of character image data corresponding to said each character of said character string in agreement with a direction corresponding to a transverse direction of said recording medium in the form of a tape, and arranging said character image data in said transverse direction of said recording medium in the form of a tape.

7. A tape printing apparatus according to claim 1, further comprising means for orienting at least one of said characters in said character string in a direction different from orientation of other of said characters in said character string.

8. A tape printing apparatus, comprising:

print format-designating means for selecting one kind of print format as a designated print format, from a plurality of kinds of print formats, each print format corresponding to instructions initially stored in a memory;

entry means for arranging entered characters to form a character string;

print image-forming means for forming print image data by editing said character string based on the instructions for said designated print format;

printing means for printing on a recording medium in the form of a tape being fed, based on said print image data, wherein said plurality of print formats are grouped into a first print format group including a vertical writing print format for printing, a horizontal writing print format for printing, and a second print format group including other print formats than said vertical writing print format and said horizontal writing print format, arranging means for making a lateral direction of said each character in agreement with a transverse direction transverse to a longitudinal direction of said recording medium in the form of a tape and arranging said each character in said longitudinal direction of said recording medium in the form of a tape for said vertical writing print format, and making a vertical direction of said each character of said character string in agreement with said transverse direction of said recording medium in the form of a tape and arranging said each character in said longitudinal direction of said recording medium in the form of a tape for said horizontal writing print format, wherein said second print format group includes a vertical writing index tab print format and a horizontal writing index tab print format for printing; and means for arranging said character string or said each character of said character string in a plurality of locations, said vertical writing index tab print format and said horizontal writing index tab print format each being used for making a label for an index tab, and wherein when any of said vertical writing index tab print format and said horizontal writing index tab print format is designated, said print image-forming means automatically sets a length of a printable area on said recording medium to a predetermined value suitable for said index tab, and forms said print image data by arranging character image data corresponding to said each character of said character string in an area corresponding to said printable area having said length thereof set to said predetermined value.

9. A tape printing apparatus according to claim 8, wherein when said vertical writing index tab print format is selected as said designated print format, said print image-forming means forms vertical writing character string image data by making a lateral direction of character image data corresponding to said each character of said character string in agreement with a direction corresponding to a transverse direction of said recording medium in the form of a tape, and arranging said character image data in a direction corresponding to said longitudinal direction of said recording medium in the form of a tape, and forms said print image data by arranging said vertical writing character string image data at both of a location corresponding to one side of a center line in said longitudinal direction of said recording medium in the form of a tape and a location corresponding to another side of said center line.

10. A tape printing apparatus according to claim 8, wherein when said horizontal writing index tab print format is designated as said designated print format, said print image-forming means forms first horizontal writing character string image data by making a vertical direction of character image data corresponding to said each character of said character string in agreement with a direction corresponding to a transverse direction of said recording medium in the form of a tape and arranging said character image data in said direction corresponding to said longitudinal direction of said recording medium in the form of a tape, and second horizontal writing character string image data by arranging said character image data in a direction corresponding to a direction opposite to said longitudinal direction of said recording medium in the form of a tape such that said second character string image data is in an inverted position and in point symmetry with said first horizontal writing character string image data, and forms said print image data by arranging said first horizontal writing character string image data at a location corresponding to one side of a center line in said longitudinal direction of said recording medium in the form of a tape and said second horizontal writing character string image data at a location corresponding to another side of said center line in said longitudinal direction of said recording medium in the form of a tape.

11. A tape printing apparatus according to claim 8, wherein said arranging means arranges said character string in agreement with the transverse direction of said recording medium.

12. A tape printing apparatus, comprising:

selection means for selecting a print format from a plurality of print formats, each print format corresponding to instructions stored in a memory;

character input means for inputting at least one character string containing a plurality of characters;

storage means for storing the character string;

printing means for printing the stored character string on a tape defining a longitudinal direction according to the instructions for the print format; and control means for equally spacing the characters of the character string along a predetermined print length and printing the characters, the control means comprising arranging means for, when the print format defines a horizontal writing index tab print format, arranging a vertical direction of each character of the stored character string in agreement with a transverse direction transverse to a longitudinal direction of the tape and arranging said each of the characters in the longitudinal direction of the tape, the character string is printed from a head thereof in a line and from a rear thereof in another line.

13. A tape printing apparatus according to claim 12, wherein the control means cancels evenly distributing the characters and performs one of the functions of centering, forward-shifting and backward-shifting of the character string.

14. A tape printing apparatus according to claim 12, further comprising alarm means for outputting an alarm when the characters in a line are entered in a greater number than a predetermined number of characters set in the line.

15. A tape printing apparatus according to claim 12, wherein the control means sets a variety of different print lengths other than the predetermined print length.

16. A tape printing apparatus according to claim 12, wherein the control means provides a non-printing area adjacent each side of the tape in the lateral direction of the tape.

17. A tape printing apparatus according to claim 12, wherein said arranging means arranges said character string in agreement with the transverse direction of said recording medium.

18. A tape printing apparatus, comprising:

selection means for selecting a print format from a plurality of print formats, each print format corresponding to instructions stored in a memory;

character input means for inputting at least one character string containing a plurality of characters;

storage means for storing the character string;

printing means for printing the stored character string on a tape defining a longitudinal direction according to the instructions for the print format; and control means for equally spacing the characters of the character string along a predetermined print length and printing the characters such that when the print format defines a vertical writing index tab print format in which a lateral direction of each character of the stored character string is arranged in agreement with a transverse direction of the tape and said each of the characters is arranged in the longitudinal direction of the tape, the character string is printed from a head thereof in two lines.

19. A tape printing apparatus according to claim 18, wherein the control means cancels evenly distributing the characters and performs one of the functions of centering, forward-shifting and backward-shifting of the character string.

20. A tape printing apparatus according to claim 18, further comprising alarm means for outputting an alarm when the characters in one line are entered in a greater number than a predetermined number of characters set in the one line.

21. A tape printing apparatus according to claim 18, wherein the control means sets a variety of different print lengths other than the predetermined print length.

22. A tape printing apparatus according to claim 18, wherein the control means provides a non-printing area adjacent each side of the tape in the lateral direction of the tape.

23. A tape printing apparatus according to claim 18, further comprising:

determination means for determining whether or not a font to be used is changed when the print format is changed from the vertical writing index tab print format to a different writing index tab print format, and vice versa, wherein when the determination means determines that a font to be used is changed, the control means controls the printing means to perform printing with the font.

24. A tape printing apparatus according to claim 18, wherein said control means arranges said character string in agreement with the transverse direction of said recording medium.

25. A method of printing characters on a tape, the method comprising the steps of:

selecting a print format from a plurality of print formats, each print format corresponding to instructions stored in a memory;

inputting at least one character string containing a plurality of characters;

storing the character string;

printing the stored character string on a tape defining a longitudinal direction according to the instructions for the print format; and equally spacing the characters of the character string along a predetermined print length and printing the characters such that when the print format defines a horizontal writing index tab print format in which a vertical direction of each character of the stored character string is arranged in agreement with a transverse direction transverse to a longitudinal direction of the tape and said each of the characters is arranged in the longitudinal direction of the tape, the character string is printed from a head thereof in a line and from a rear thereof in another line.

26. A method of printing characters on a tape according to claim 25, wherein the character string is oriented in the transverse direction of the tape.

27. A method of printing characters on a tape, the method comprising the steps of:

selecting a print format from a plurality of print formats, each print format corresponding to instructions stored in a memory;

inputting at least one character string containing a plurality of characters;

storing the character string;

printing the stored character string on a tape defining a longitudinal direction according to the instructions for the print format; and equally spacing the characters of the character string along a predetermined print length and printing the characters such that when the print format defines a vertical writing index tab print format in which a lateral direction of each character of the stored character sting is arranged in agreement with a transverse direction transverse to a longitudinal direction of the tape and said each of the characters is arranged in the longitudinal direction of the tape, the character string is printed from a head thereof in two lines.

28. A method of printing characters on a tape according to claim 27, wherein the character string is oriented in the transverse direction of the tape.

* * * * *

UNITED STATES PATENT AND TRADEMARK OFFICE

CERTIFICATE OF CORRECTION

PATENT NO. : 6,045,277
DATED : April 4, 2000
INVENTOR(S) : H. Kurashina et al.

It is certified that error appears in the above-identified patent and that said Letters Patent is hereby corrected as shown below:

On the cover page please add the Assignee's name as follows:
King Jim Co., Ltd., Tokyo, Japan Signed and Sealed this Twelfth Day of June, 2001

Nicholas P. Godici

*Attest:*

*Attesting Officer*

NICHOLAS P. GODICI
*Acting Director of the United States Patent and Trademark Office*